US007547410B2

(12) United States Patent
Taniguchi

(10) Patent No.: US 7,547,410 B2
(45) Date of Patent: Jun. 16, 2009

(54) METAL HEAT TREATMENT SYSTEM HOT-GAS QUENCHING APPARATUS AND HOT-GAS HEAT TREATMENT SYSTEM

(76) Inventor: Hirohisa Taniguchi, 3-15, Nakahagi-cho, Niihama-shi, Ehime 792-0045 (JP)

( * ) Notice: Subject to any disclaimer, the term of this patent is extended or adjusted under 35 U.S.C. 154(b) by 0 days.

(21) Appl. No.: 12/026,686

(22) Filed: Feb. 6, 2008

(65) Prior Publication Data

US 2008/0197546 A1 Aug. 21, 2008

Related U.S. Application Data

(62) Division of application No. 10/508,499, filed as application No. PCT/JP02/11005 on Oct. 23, 2002.

(30) Foreign Application Priority Data

Mar. 25, 2002 (JP) ..... 2002-084230
Jun. 11, 2002 (JP) ..... 2002-170194

(51) Int. Cl.
*C21D 1/06* (2006.01)

(52) U.S. Cl. ..... 266/259; 266/251

(58) Field of Classification Search ..... 266/78, 266/80, 259, 250, 251
See application file for complete search history.

(56) References Cited

U.S. PATENT DOCUMENTS 4,634,103 A * 1/1987 Schmetz et al. ..... 266/259
5,121,903 A * 6/1992 Ripley et al. ..... 266/250
5,173,124 A * 12/1992 Baxter et al. ..... 266/80
6,203,634 B1 3/2001 Volkmuth

FOREIGN PATENT DOCUMENTS

| | | |
|---|---|---|
| DE | 19902032 | 6/2000 |
| DE | 10044362 | 4/2002 |
| JP | 3253512 | 11/1991 |
| JP | 2558657 | 12/1997 |
| JP | 2859704 | 2/1999 |
| JP | 200097576 | 4/2000 |
| JP | 2001267264 | 9/2001 |

OTHER PUBLICATIONS

International Search Report dated Jan. 21, 2003.
European Search Report dated Dec. 5, 2005.
Korean Official Action dated Dec. 26, 2005.
"Heat Treatment with Salt Bath", The Japan Society for Heat Treatment, Aug. 30, 2000, pp. 144-147.
"Salt Bath" The Japan Society for Heat Treatment, Aug. 30, 2000, pp. 769-773.

* cited by examiner

*Primary Examiner*—Scott Kastler
(74) *Attorney, Agent, or Firm*—Carlson, Gaskey & Olds

(57) ABSTRACT

A metal heat treatment method includes quenching a workpiece by blowing an inert gas onto the workpiece, adjusting the temperature of the inert gas to approximately an isothermal holding temperature of the workpiece for transformation of the workpiece, holding the isothermal holding temperature within a margin of error of approximately plus or minus five degrees Celsius for a given period, and performing a metal heat treatment with the isothermal holding temperature kept statically or dynamically by varying the temperature of the hot-gas.

14 Claims, 11 Drawing Sheets

METAL HEAT TREATMENT SYSTEM HOT-GAS QUENCHING APPARATUS AND HOT-GAS HEAT TREATMENT SYSTEM

REFERENCE TO RELATED APPLICATION

This application is a divisional of U.S. application Ser. No. 10/508,499 filed May 27, 2005 which claims priority to PCT Application PCT/JP02/011005 filed on Oct. 23, 2002, which claims priority to Japanese Patent Application No. JP 2002-084230 filed on Mar. 25, 2002 and Japanese Patent Application No. JP 2002-170194 filed on Jun. 11, 2002.

TECHNICAL FIELD

The present invention relates to a metal heat treatment method, a hot-gas quenching apparatus and a hot-gas heat treatment system to heat-treat effectively without a salt bath by use of hot-gas adjusted to hold a given intermediate temperature of an inert gas such as $N_2$ or Ar in accordance with a transformation temperature of a metal.

BACKGROUND ART

A well-known quenching method for metal is to quench a workpiece preheated at an initial quenching temperature to room temperature before annealing the workpiece. Also, there is an austempering method, a martempering method and a marquenching method, referred to as "isothermal holding heat treatment", to hold a given intermediate temperature based on an S-curve (T, T, T curve) for a certain period.

Another well-known method is isothermal holding heat treatment with a salt bath disclosed in "Heat Treatment with Salt Bath" published by The Japan Society for Heat Treatment, Aug. 30, 2000, p. 144-147. The salt bath is prepared at 150 to 550 degrees Celsius as a low temperature, 570 to 950 degrees Celsius as a intermediate temperature, and 1000 to 1300 degrees Celsius as a high temperature. Materials for the salt bath are $KNO_2$, a mixture of $KNO_3$ and $NaNO_2$, a mixture of $BaCl_2$ and KCl or $CaCl_2$, or a mixture of NaCl and LiCl or KCl, depending on zones of temperature.

Some solutions have been proposed so as to solve a difficult problem of quenching the workpiece removed from a preheating furnace in the process of the heat treatment with the salt bath. The proposed solutions are shown in "Salt Bath" published by The Japan Society for Heat Treatment, Aug. 30, 2000, p. 769-773. For example, one of the proposed solutions includes a step of providing a salt bath in a vacuum furnace to be heated, a step of removing a workpiece with salt on the face of the workpiece, a step of sequentially moving the workpiece with an anticorrosive coating to the salt bath at a lower temperature, and a step of holding a given intermediate temperature of the salt bath. The workpiece is moved between salt bathes with chain block and the like. Because of the heated workpiece and the heated salt bath at high temperature, skill and caution are needed to perform this solution.

Another solution, referred to as "continuous heat treatment", includes a step of providing a salt bath for an austempering operation in the lower part of a preheating furnace, a step of moving a workpiece into a salt bath from the preheating furnace, and a step of sequentially moving the workpiece with a belt conveyor. The solution has a problem in that there are many restrictions for the workpiece under the austempering operation.

Still another solution, referred to as "versatile heat treatment", includes a step of austempering a workpiece with a preheating furnace connected to a quenching salt bath by use of a fully automated operation of tray batch automating transportation. This solution still requires a salt bath and an extensive operation thereof. Those solutions described above requires the steps of soaking a workpiece in a salt bath and removing the workpiece therefrom, and a step of quenching the workpiece or holding the workpiece at an isothermal holding temperature. Therefore, means for soaking and removing the workpiece in those solutions creates a restriction on the heat treatment in itself. For example, in the temperature programmed austempering method, after a workpiece is quenched to 200 degrees Celsius, the workpiece is heated to 250 degrees Celsius, the workpiece is maintained at the isothermal holding temperature, and then the workpiece is quenched again. A plurality of salt bathes are required, and means for moving the workpiece to the salt bathes for these complicated steps, increases the scale of a plant and the cost of the products.

Because of environmental pollution caused by a use of a salt bath, a quenching method without a salt bath is proposed. The method which omits the salt bath includes steps quenching and cooling a workpiece with an inert gas, such as $N_2$ or Ar. According to the method of Japanese Patent Laid Open Publication (Kokai) No. 5-66090 includes a step of accommodating a workpiece in a pressure tight vacuum furnace to heat the workpiece at 1000 to 1200 degrees Celsius, a step for intake of inert gas at 5 degrees Bar so as to quench the workpiece, and a step of circulating the gas with a turbo blower to quench the workpiece relatively quickly. The vacuum furnace includes means, such as a heater, for performing operations on the workpiece for a sequence of heating treatments such as a cooling treatment, a primary preheating treatment, a secondary preheating treatment, a preheating treatment for quenching, and an operation to hold the preheating temperature. After the sequence of heating treatments, $N_2$ gas is pulled into the furnace to quench the workpiece, completing a quenching treatment. This type of furnace is referred to as "a blast furnace".

The blast furnace is able to quench the preheated workpiece to room temperature for the quenching treatment. However, the blast furnace is not able to hold the isothermal holding temperature at an intermediate temperature for the heating treatment required by the austempering method, the martempering method and the marquenching method.

A way for the austempering method to hold an isothermal holding temperature in the blast furnace is by setting a constant temperature for a certain period as a target temperature controlled by a control unit. The control unit turns on the heater when the temperature falls below the target temperature, and turns off the heater when the temperature exceeds the target temperature.

The gas circulated by the blower is constantly cooled by a cooling system. Therefore, the temperature in the blast furnace varies drastically from 100 degrees Celsius below the target temperature to 50-100 degrees Celsius above the target temperature. Because of the drastic variation of temperature, the blast furnace is unable to hold an isothermal holding temperature. Because the inert gas introduced into the furnace is at room temperature, a problem of partial undercooling arises. It is difficult to heat the inert gas to solve the problem.

DISCLOSURE OF INVENTION

The present invention was developed to provide a new gas quenching method, which is able to sustain an isothermal holding temperature. As a result of research by the present invention, it was recognized that at least the inert gas initially introduced into a furnace should have a high temperature, for example, a high temperature around Ms point, because the inert gas blown onto the workpiece at room temperature for quenching causes the problem of partial undercooling. Then, research was conducted on the high temperature inert gas specifically, and the conception of a "hot-gas" quench was developed. The hot-gas is inert gas used for cooling a workpiece to a target temperature. The hot-gas has a temperature, for example, an intermediate temperature above the Ms point, at which the workpiece is not undercooled in accordance with a quenching method. More specifically, the hot-gas is an inert gas which is adjusted to a given intermediate temperature in accordance with a transformation temperature referred to as a target temperature for an isothermal holding temperature. By means of the generated hot-gas blowing onto the workpiece, the workpiece is quenched and maintained at an isothermal holding temperature without undercooling.

It is an object of the present invention to provide a metal heat treatment method to perform heat treatment with an isothermal holding temperature, a hot-gas quenching apparatus, and a hot-gas heat treatment system for the heat treatment method. According to the present invention, a heat treatment with hot-gas is performed more safely and more effectively than in the related art. Controlling the temperature of the hot-gas provides a new metal heat treatment method, which is not achieved by the prior method using a salt bath.

Specifically, it is an object of the present invention to provide five types of hot-gas quenching apparatuses for any types of quenching method, such as an austempering method, a temperature programmed austempering, a martempering method and a marquenching method to hold an intermediate temperature. The five types include "a basic type", "a gas-preheated type", "a contact-media-in-the-mixer type", "a contact-media-in-the-duct type", and "a crucible type".

Further, it is an objection of the present invention to provide a hot-gas heat treatment system including the hot-gas quenching apparatus with a preheating furnace to hold an isothermal holding temperature.

For solving the problem described above, an aspect of the present invention inheres in a metal heat treatment including quenching a workpiece by blowing a hot-gas, that is, an inert gas adjusted at a temperature around isothermal transformation temperature of the workpiece, onto the workpiece, holding a temperature within plus or minus five degrees Celsius of the isothermal transformation temperature for a given period, and performing a metal heat treatment with the isothermal transformation temperature statically or dynamically maintained in accordance with the metal heat treatment, by the variable temperature of the hot-gas.

According to the present invention, the metal heat treatment is performed more safely and more effectively by use of the hot-gas for the metal heat treatment to hold the isothermal holding temperature compared to the prior methods using the salt bath. Additionally, temperature is controlled easily, quickly, and programmably to hold the isothermal holding temperature statically and dynamically without the restriction of the salt bath. The term "dynamically" means "quickly" and "programmably". For example, by setting the temperature of the gas to 300 degrees Celsius for 10 minutes, then at 315 degrees Celsius for 20 minutes, finally at 305 degrees Celsius for 30 minutes, the temperature of the gas is systematically and exactly controlled for a given period.

According to the present invention, the metal heat treatment methods with the salt bath, such as the austempering method, the martempering method and the marquenching method, are improved.

Table 1 shows the five types with each characteristic, respectively. As for the five types of apparatuses of the present invention, the basic type is described as H•O•T-1, the gas-preheated type is described as H•O•T-2, the contact-media-in-the-mixer is described as H•O•T-3, the contact-media-in-the-duct type is described as H•O•T-4, and the crucible type is described as H•O•T-5.

TABLE 1

LIST OF FIVE TYPES OF HOT-GAS QUENCHING APPARATUS

| TYPE | ; WINDOW<br>◪ ;QUENCHING SYSTEM<br>⊠ :MIXER<br>⊗ :BLOWER<br>•;CONTACT MEDIA<br>W;WORKPIECE | APPLICATION |
|---|---|---|
| BASIC HOT-1 | 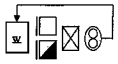 | ATMOSPHERE FURNACE<br>NON-PREHEATED INERT GAS<br>NO CONTACT MEDIA |
| GAS-PREHEATED HOT-2 | 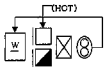 | VACUUM FURNACE<br>PREHEATED INERT GAS<br>NO CONTACT MEDIA |
| CONTACT MEDIA IN MIXER HOT-3 | 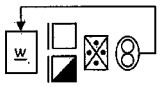 | VACUUM FURNACE<br>ATMOSPHERE FURNACE<br>NON-PREHEATED INERT GAS<br>CONTACT MEDIA (300 Kg) |
| CONTACT MEDIA IN DUCT HOT-4 | 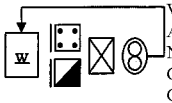 | VACUUM FURNACE<br>ATMOSPHERE FURNACE<br>NON-PREHEATED INERT GAS<br>CONTACT MEDIA (1ton) |
| CRUCIBLE HOT-5 | 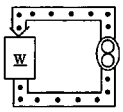 | ATMOSPHERE FURNACE<br>NON-PREHEATED INERT GAS<br>CONTACT MEDIA (1 ton) |

A hot-gas quenching apparatus of basic type H•O•T-1 according to the present invention is a hot-gas quenching apparatus in which a workpiece preheated to an initial temperature to be applied when an quenching is started is cooled rapidly to an intermediate temperature set around an isothermal transformation temperature of the workpiece, and which subsequently an isothermal holding can be performed. The hot-gas quenching apparatus is characterized by comprising: a workpiece container for containing the preheated workpiece in an inert gas atmosphere; first (for higher temperatures) and second (for lower temperatures) ducts which are so arranged to branch from a flow path connecting to the workpiece container, and which respectively have a control window whose aperture can be regulated; a gas quenching unit, arranged in the second duct, for cooling to a room temperature inert gas introduced from an inlet of the second duct; a mixer, arranged at a terminus of each of the first and second ducts, for mixing to an even temperature inert gases of different temperatures which have been transferred from the respective ducts; a distributor for dividing inert gas introduced from the mixer and introducing the divided inert gas into capillaries, and for blowing the inert gas onto the outer peripheral surface of the workpiece evenly; a blower, arranged between the mixer and the distributor, for pressurizing the inert gas introduced from the mixer and supplying the inert gas to the distributor; inert gas introducing unit for blowing a required amount of inert gas into any of the first and second ducts; and a controller for controlling and regulating the degrees of the opening of the control windows to cause the temperature of the gas introduced from the mixer to be equal to the intermediate temperature while driving the blower and introducing the inert gas.

With regard to the hot-gas quenching apparatus according to the present invention, a workpiece is in an inert gas atmosphere before quenching is started. For this reason, amounts of inert gases of high and low temperatures which flow in the first and second ducts respectively can be regulated, and the both gases can be mixed by the mixer arranged at the terminuses of both ducts. Thus, inert gas of an optional temperature can be generated.

Each duct and the control window arranged therein are what regulate a rate of gas flowing in each duct. A degree of the opening (an aperture) of each of the control window may be controlled individually or in a linked manner. In addition, it suffices in a functional term if each duct and the accompanying control window do nothing but control an amount of gas. For example, each duct may be constituted to be an air channel, and the sectional form may be angular or circular. Each duct can be constituted by assembling pipe materials. Furthermore, each control window may be constituted to be capable of closing the opening portion with a plate member, or else with a valve member. With regard to a control method, the opening portion may be controlled as a whole. Or else, an overall flow amount may be regulated in a manner that the opening portion is divided into a plurality of parts and some of the plurality of parts is controlled so that the parts are opened or closed, respectively.

Examples of gas quenching units include an example of a water cooling unit. Also, an air cooling unit can be used. In addition, an example of a cooling unit which uses other than water or air as a cooling medium is conceivable. In a practical term, however, a water cooling unit is preferable. For this reason, in the present invention, the gas quenching unit will be described assuming that a water cooling unit is used.

In general, gas flowing in the first duct is introduced from the distributor, and then the gas is cooled. The temperature of the gas is 600 to 700° C. as an initial temperature of the gas, and subsequently comes to be equal to intermediate temperatures regulated in the present invention, for example 200 to 500° C., and finally drops to a room temperature. At that time, since the first duct is constituted merely to pass the gas, the wall surface may be constituted to be covered by a carbon fire resisting material or the like when deemed necessary. In addition, with regard to the second duct, a water cooling unit is arranged inside of the second duct. For this reason, the gas of a high temperature, which is introduced into the second duct, can be cooled to a room temperature rapidly, and the temperature of the second duct is always in the vicinity of a room temperature. Consequently, the second duct does not have to have a fire resisting structure, and can be constituted simply.

The mixer is merely what evenly mixes gases introduced from the first and second ducts. Consequently, the mixer can be realized as a structure just for mixing gases received from the first and second ducts respectively with a metal piece, a plate, a conduit or the like.

The water cooling unit, a distributor and a blower can be constituted of conventional units as in a case of a jet stream duct disclosed in Japanese Patent Laid-open No. 5-66090 citing a conventional example. An output temperature of the water cooling unit by a cooling water duct can be set at 20 to 100° C. corresponding to the temperature of an gas introduced into the water cooling unit.

In the hot-gas quenching apparatus H•O•T-1 according to the present invention, the temperature of inert gas introduced from the mixer can be regulated so that the temperature drops to an intermediate temperature. Consequently, inert gas of a room temperature may be introduced into any of the first and second ducts. For example, inert gas introduced into the first duct is mixed with inert gas flowing in the first duct, and then is mixed with inert gas introduced from the second duct. Thus, the inert gas comes to be equal to an intermediate temperature, and is introduced into the distributor. An amount of introduced gas is regulated so that the gas concentration enables a workpiece to be cooled rapidly, i.e. so that the pressure is caused to be 5 degrees Bar, for example. The controller always monitors the output temperature of the mixer, and controls an aperture of the control window provided to each duct in order to cause the temperature of the inert gas introduced from the distributor to be equal to a target temperature with the intermediate temperature defined as the target temperature. The target temperature can be change. In other words, in a case that an isothermal holding temperature in an austempering is 300° C., a target temperature can be initially 200° C., and then 300° C. or the like. In the present invention, gas at these intermediate temperatures is referred to as "hot-gas."

Because of the aforementioned constitution and specification, gas passing through the distributor always has a temperature controlled by the controller. Consequently, gas of such a low temperature which causes a workpiece to be undercooled is never introduced. In addition, since the temperature is controlled in a way that amounts of gas passing through the first and second ducts are regulated, the control can be performed precisely, and a temperature control within a range of −1% to +1% can be sufficiently performed in an isothermal holding step.

As described above, the hot-gas quenching apparatus H•O•T-1 according to the present invention can quench a workpiece contained in an inert gas atmosphere at an intermediate temperature, or can hold the workpiece isothermally. Furthermore, in no case does an undercooling occur. In addition to the austempering, a quenching which requires an isothermal holding at an intermediate temperature such as a martempering, a temperature programmed austempering and the like can be performed.

A hot-gas quenching apparatus of gas-preheated type H•O•T-2 according to the present invention is a hot-gas quenching apparatus in which a workpiece preheated to an initial temperature to be applied when an quenching is started is cooled rapidly to an intermediate temperature set around an isothermal transformation temperature of the workpiece, and which subsequently an isothermal holding can be performed. The hot-gas quenching apparatus is characterized by comprising: a workpiece container for containing the preheated workpiece in vacuo; first (for higher temperatures) and second (for lower temperatures) ducts which are so arranged to branch from a flow path connecting to the workpiece container, and which respectively have a control window whose aperture can be regulated; a gas quenching (water cooling) unit, arranged in the second duct, for cooling to a room temperature inert gas introduced from an inlet of the second duct; a mixer, arranged at a terminus of each of the first and second ducts, for mixing to an even temperature inert gases of different temperatures which have been transferred from the respective ducts; a distributor for dividing inert gas introduced from the mixer and introducing the divided inert gas into capillaries, and for blowing the inert gas onto the outer peripheral surface of the workpiece evenly; a blower, arranged between the mixer and the distributor, for pressurizing the inert gas introduced from the mixer and supplying the inert gas to the distributor; inert gas introducing unit for blowing inert gas preheated to the intermediate temperature into an optional position, except for the second duct; and a controller for controlling and regulating the degrees of the opening of the control windows to cause the temperature of the introduced gas from the mixer to be equal to the intermediate temperature while driving the blower and introducing the inert gas.

The hot-gas quenching apparatus of gas preheating type H•O•T-2 according to the present invention is adapted to a case that a workpiece is contained in vacuo. Introduced inert gas has to be preheated to an intermediate temperature, for example 150 to 300° C. In other words, the first and second ducts are constituted merely to pass gas, as in the case of the aforementioned hot-gas quenching apparatus H•O•T-1. For this reason, if inert gas of a room temperature is introduced into any of the first and second ducts, the inert gas of the room temperature is blown onto the workpiece through the distributor. This causes an undercooling. With this taken into consideration, in the present invention, inert gas is introduced after being preheated to the intermediate temperature. Accordingly, gas to be blown onto the workpiece in an initial phase can be caused to be at the intermediate temperature which does not bring about an undercooling, and the undercooling will not occur.

The preheating of introduced gas can be performed with an electric heater or a heat exchanger. An amount of introduced gas is on the order of one to several kilograms. This amount may be heated up to approximately 150° C. Energy required is on the order of 500 to 1,000 kcal. Since a preheating temperature is different from a temperature to be controlled which the controller controls, the preheating temperature may be determined as a temperature which does not cause an undercooling. For example, an isothermal holding can be made in a way that a preheating temperature of inert gas is 150° C., and that a temperature to be controlled is 200° C. in an early period and 300° C. in a last period. A reason why the temperature to be controlled in the initial period is set lower than that in the last period is that a cooling is made as rapidly as possible.

As described above, the hot-gas quenching apparatus H•O•T-2 according to the present invention can cool to an intermediate temperature a workpiece contained in vacuo, and can hold the workpiece isothermally, while blowing in preheated inert gas. Consequently, isothermal heating processes such as an austempering, a martempering and a temperature programmed austempering can be also performed.

A hot-gas quenching apparatus of contact-media-in-the-mixer type H•O•T-3 according to the present invention is a hot-gas quenching apparatus in which a workpiece preheated to an initial temperature to be applied when an quenching is started is cooled rapidly to an intermediate temperature set around an isothermal transformation temperature of the workpiece, and which subsequently an isothermal holding can be performed. The hot-gas quenching apparatus is characterized by comprising: a workpiece container for containing the preheated workpiece in vacuo or in an inert gas atmosphere; first (for higher temperatures) and second (for lower temperatures) ducts which are so arranged to branch from a flow path connecting to the workpiece container, and which respectively have a control window whose aperture can be regulated; a gas quenching (water cooling) unit, arranged in the second duct, for cooling to a room temperature inert gas introduced from an inlet of the second duct; a mixer, arranged at a terminus of each of the first and second ducts, for mixing to an even temperature inert gases of different temperatures which have been transferred from the respective ducts; a distributor for dividing inert gas introduced from the mixer and introducing the divided inert gas into capillaries, and for blowing the inert gas onto the outer peripheral surface of the workpiece evenly; a blower, arranged between the mixer and the distributor, for pressurizing the inert gas introduced from the mixer and supplying the inert gas to the distributor; heat storage contact media, arranged in the mixer, and having a gas permeability and a heat capacity, for exchanging heat with inert gas introduced into the inlet of the mixer; inert gas introducing unit for blowing inert gas (inert gas of a room temperature is acceptable) into a frontal stage of the mixer; and a controller for controlling and regulating the degrees of the opening of the control windows to cause the temperature of the introduced gas from the mixer to be equal to the intermediate temperature while driving the blower and introducing the inert gas.

With regard to the hot-gas quenching apparatus of basic type H•O•T-3 according to the present invention, the heat storage contact media is arranged in the mixer arranged at the terminuses of the first and second ducts. The heat storage contact media is a substance such as a metal which can exchange accumulated heat with inert gas when in contact with the inert gas, and is constituted to have a good gas permeability.

Examples of heat storage contact media include chips and a steel ball of a metal such as iron, and a pipe material. In brief, whatever material suffices if the material can exchange heat with inert gas flowing in the ducts, and if the material thereby can convert the temperature of the inert gas into a preheating temperature of the heat storage contact media. A heat capacity Qm of contact media can be determined by use of a ratio of it to a heat capacity Qw of a workpiece contained in the workpiece container. For a calculation, the heat capacity Qm of the contact media can be determined by use of a weight ratio, if the workpiece and the contract material are of the same quality of material.

The heat capacity Qm of heat storage contact media needs to be approximately 0.1 to 0.3 times as much as the heat capacity Qw of a workpiece, when the heat capacity of the workpiece is defined as Qw. In order to blow inert gas of a room temperature which has been introduced in an initial period onto a workpiece while causing the inert gas to have a temperature which does not bring about an undercooling, the heat capacity Qm of heat storage contact media has to be determined in response to an amount of introduced inert gas. If the heat capacity is too small, an amount of introduced inert gas is restricted to a large extent. The larger the heat capacity is, the more stable the inert gas is. Accordingly, however, the measurement of the mixer becomes large. With this taken into consideration, it is practically determined that the heat capacity Qm of heat storage contact media is approximately 0.3 times as much as the heat capacity Qw of a workpiece.

As described above, according to the hot-gas quenching apparatus H•O•T-3 according of the present invention, in a case that a workpiece is contained in vacuo, inert gas of a room temperature introduced into the second duct is heated up to a temperature which does not cause contact media in the mixer to undercool a workpiece, e.g. 200° C., and then is blown onto the workpiece.

In a case that the container is not in vacuo but in an inert gas atmosphere in an initial period, the temperature of the inert gas can be controlled in order not to cause an undercooling from the beginning through regulating the degrees of the opening of the control window in each duct, as shown in the aforementioned hot-gas quenching apparatus H•O•T-1. In the present invention, however, a small amount of heat storage contact media is arranged in the mixer. For this reason, gas of a high temperature introduced from the container can be rapidly cooled to a temperature which the contact media have.

Accordingly, a workpiece can be cooled more rapidly by enlarging a gas density, i.e. a pressure of the gas and a flow rate of the gas.

A hot-gas quenching apparatus of contact media-in-the-duct type H•O•T-4 according to the present invention is a hot-gas quenching apparatus in which a workpiece preheated to an initial temperature to be applied when an quenching is started is cooled rapidly to an intermediate temperature set around an isothermal transformation temperature of the workpiece, and which subsequently an isothermal holding can be performed. The hot-gas quenching apparatus is characterized by comprising: a workpiece container for containing the preheated workpiece in vacuo or in an inert gas atmosphere; first (for higher temperatures) and second (for lower temperatures) ducts which are so arranged to branch from a flow path connecting to the workpiece container, and which respectively have a control window whose aperture can be regulated; heat storage contact media, arranged in the first duct, and having a gas permeability and a heat capacity, for exchange heat with inert gas introduced from the inlet of the first duct; a water cooling unit, arranged in the second duct, for cooling to a room temperature inert gas introduced from the inlet of the second duct; a mixer, arranged at a terminuses of the first and second ducts, for mixing to an even temperature inert gases of different temperatures which have been transferred from the respective ducts; a distributor for dividing inert gas introduced from the mixer and introducing the divided inert gas into capillaries, and for blowing the inert gas onto the outer peripheral surface of the workpiece evenly; a blower, arranged between the mixer and the distributor, for pressurizing the inert gas introduced from the mixer and supplying the inert gas to the distributor; inert gas introducing unit for blowing inert gas (inert gas of a room temperature is acceptable) into a frontal stage of the mixer; and a controller for controlling and regulating the degrees of the opening of the control windows to cause the temperature of the introduced gas from the mixer to be equal to the intermediate temperature while driving the blower and introducing the inert gas.

Unlike the aforementioned hot-gas quenching apparatus H•O•T-3, the hot-gas quenching apparatus H•O•T-4 according to the present invention has heat storage contact media arranged in the first duct instead of in the mixer. Since the measurements of the duct can be designed freely, a large amount of heat storage contact media can be arranged therein. When a workpiece is at 1,000° C. and weighs 1 ton, if the workpiece and each iron contact media of 250° C. having different weights are arranged together in the duct, equilibrium temperatures are as shown in the following Table 2.

TABLE 2

EQUILIBRIUM TEMPERATURE OF A WORKPIECE AT 1000° C. AND A CONTACT MEDIA AT 250° C.

| CONTACT MEDIA | EQULIBRIUM TEMPERATURE |
|---|---|
| 0.3 ton | 885° C. |
| 10. ton | 625° C. |
| 5.0 ton | 375° C. |
| 10.0 ton | 318° C. |
| 20.0 ton | 296° C. |
| 30.0 ton | 274° C. |
| 50.0 ton | 264° C. |

As shown in Table 2, if contact media having the same weight (1.0 ton) as the workpiece are arranged therein, the equilibrium temperature comes to be just equal to the middle temperature. If contact media having ten times as heavy as the workpiece are arranged therein, the equilibrium temperature rises by 68° C. from 250° C. If contact media having 30 times as heavy as the workpiece are arranged therein, a rise in temperature can be confined to 24° C.

The quenching of a metal requires a rapid cooling. In other words, a workpiece preheated at 1,000 to 1,350° C. has to be cooled down to a target temperature, e.g. 300° C., determined in relation to a transformation temperature within a few minutes. With this taken into consideration, by arranging contact media, having the same weight as a workpiece does, in the first duct, a larger amount of gas comes to be capable of being supplied at a higher pressure at a higher rate, and a rapid quenching can be made possible.

If it is in front of the aforementioned contact media that inert gas is introduced, the introduced inert gas is heated by the contact media and is turned into hot-gas. For this reason, whether a workpiece may be contained in vacuo or in an inert gas atmosphere, a preheating is not needed. If the inert gas is introduced by each little amount, a position into which the inert gas is introduced is not necessarily the front of the contact media. If, however, the position into which the inert gas is introduced is the front of the contact media, a required amount of inert gas can be introduced without causing unevenness in the temperature, and this is most preferable.

As described above, according to the hot-gas quenching apparatus of contact media-in-the-duct type H•O•T-4 of the present invention, a required amount, e.g. 1 ton, of heat storage contact media is arranged in the first duct. For this reason, whether a workpiece may be contained in vacuo or in an inert gas atmosphere, hot-gas accompanying the beginning of a quenching can be at an intermediate temperature to be determined by a preheating temperature of the contact media, and thereby the workpiece can be cooled by blowing a larger amount of hot-gas onto the workpiece. In addition, since control of an intermediate temperature is performed by regulating degrees of the opening of control windows provided to the first and second ducts, the control of the intermediate temperature can be performed with ease and with high precision.

A hot-gas quenching apparatus of crucible type H•O•T-5 according to the present invention is a hot-gas quenching apparatus in which a workpiece preheated to an initial temperature to be applied when an quenching is started is cooled rapidly to an intermediate temperature set around an isothermal transformation temperature of the workpiece, and which subsequently an isothermal holding can be performed. The hot-gas quenching apparatus is characterized by comprising: a workpiece container for containing the preheated workpiece in vacuum or in an inert gas atmosphere; a distributor for dividing inert gas extracted from a gas extracting inlet (a rear window 9) provided in the workpiece container and introducing the divided inert gas into capillaries, and for blowing the inert gas onto the outer peripheral surface of the workpiece evenly; a gas circulation duct arranged between the gas extracting inlet and the distributor; a blower, arranged in the circulation duct, for supplying pressurized gas to the distributor; a large amount of heat storage contact media arranged in the circulation duct; and a temperature adjuster consisting of a heater and/or a cooler for holding the heat storage contact media at the intermediate temperature.

According to the hot-gas quenching apparatus H•O•T-5 of the present invention, a hot-gas heat bath (crucible) can be realized in place of a conventional salt bath, as in the case of the aforementioned hot-gas quenching apparatuses H•O•T-1 to H•O•T-4. Accordingly, the temperature of the contained workpiece can be mixed evenly with the temperature of contact media, and an isothermal holding can be performed at a required temperature. Also, a rapid cooling can be performed. By changing the temperature of hot-gas, i.e. the temperature of contact media, a normal quenching and an austempering can be also performed. The hot-gas heat bath (crucible) can be used as a tempering furnace.

The hot-gas quenching apparatus H•O•T-5 is different from the other hot-gas quenching apparatuses H•O•T-1 to H•O•T-4 in that an amount of contact media shown in FIG. 2 is increased sufficiently to balance the temperatures of a workpiece and the contact media and thereby a rapid cooling is performed. The hot-gas quenching apparatus H•O•T-5 does not need the second duct which the aforementioned hot-gas quenching apparatuses H•O•T-1 to H•O•T-4 have.

The heat capacity of contact media in the hot-gas quenching apparatus H•O•T-5 is caused to be 5 to 10 times as large as that of a workpiece, preferably 10 to 30 times as large as that of the workpiece, with the heat capacity of the workpiece defined as a reference. The heat capacity of the contact media should be a capacity sufficient for the workpiece to be cooled rapidly without operating a water cooling unit. This enables a rapid cooling down to an intermediate temperature and an isothermal holding to be performed with driving a blower.

With regard to the hot-gas quenching apparatus H•O•T-5 according to the present invention, an amount of used contact media is large, and accordingly change of an initial preheating temperature of contact media takes a slightly longer time and a slightly larger heat quantity. Consequently, if a plurality of hot-gas quenching apparatuses H•O•T-5 is arranged, and is managed at different temperatures, for example 200° C. and 250° C., a rapid response to a desired temperature can be performed, and accordingly various heat treatments can be performed efficiently and smoothly.

A hot-gas heat treatment system in accordance with the present invention is a hot-gas heat treatment system H•O•T•S which can adapt various isothermal holding heat treatment methods to a large numbers of workpieces while rapidly cooling, or isothermally holding, the workpieces preheated to an initial temperature to be applied when a quenching is started, and which can perform the heat treatments sequentially and efficiently. The hot-gas heat treatment system comprises; a preheating furnace for preheating the workpieces to an initial temperature to be applied when a quenching is started; workpiece transporter for transferring the workpieces preheated by the preheating furnace while holding the workpieces at the initial temperature; and hot-gas quenching units H•O•T-i (i=1 to 5) for receiving the workpieces transferred by the workpiece transporter, and for rapidly cooling or isothermally holding the workpieces to an intermediate temperature set between the initial temperature and a room temperature. The hot-gas heat treatment system is characterized in that the workpieces preheated by the preheating furnace are transferred to the hot-gas quenching apparatuses, and in that accordingly an austempering, a temperature programmed austempering, a martempering, a marquenching, and other heat treatments are performed efficiently.

The workpiece transporter includes; temperature retaining or heat retaining means referred to as "keep-warm unit"; and gas pressure regulator means for regulating an internal pressure. The workpiece transporter can be constituted of a robot capable of moving in a heat treatment factory automatically. In addition, the hot-gas heat treatment system can be constituted of a tunnel structure including the keep-warm unit for holding the preheated workpiece at he initial temperature; the gas pressure regulator means for regulating an internal pressure; and the workpiece transporter.

The hot-gas heat treatment system H•O•T•S of the present invention includes the various hot-gas quenching apparatuses H•O•T-i (i=1 to 5) in various heat treatment system, and can transfer a workpiece. The hot-gas heat treatment system can also adapt various heat treatment methods to a large numbers of workpieces while rapidly cooling, or isothermally holding, the workpieces preheated to an initial temperature to be applied when a quenching is started, and can perform the heat treatments sequentially and efficiently.

Examples of system constitutions include an example of a combination of the hot-gas quenching apparatuses H•O•T-i (i=1 to 5) and a plurality of preheating furnaces in series or in parallel. In the hot-gas heat treatment system where workpieces are transferred continuously in a combination of hot-gas quenching apparatuses and preheating furnaces in series, workpieces transferred intermittently can be quenched sequentially and efficiently. Unlike a conventional system using a salt bath, the hot-gas heat treatment system according to the present invention does not require a workpiece to be immersed or taken up, and does not deteriorate the environments. The hot-gas heat treatment system can be arranged freely, and can be a flexible heat treatment system having a wide range of adaptability.

In a heat treatment using the above described hot-gas quenching apparatuses and hot-gas heat treatment system according to the present invention, since a heat treatment by a isothermal holding is performed, a risk of surface deterioration such as decarbonization and oxidation can be prevented. In addition, since surface roughness and warping do not occur, costs for refinishing can be reduced. By this heat treatment, a workpiece can have toughness, and can avoid a crack. Also, life of the workpiece can be made longer. Automation of the system enables management parameters to be observed surely and quality to be assured. The system eliminates uncomfortable environments, and does not cause problems of pollution or waste water. Smooth operation can be performed, and processing costs can be reduced. In this way, various benefits can be brought about.

DETAILED DESCRIPTION OF THE PREFERRED EMBODIMENT

With regard to hot-gas quenching apparatuses H•O•T-i (i=1 to 5) and a hot-gas heat treatment system H•O•T•• S according to the present invention, embodiments will be described sequentially with reference to attached drawings.

Figure 1:
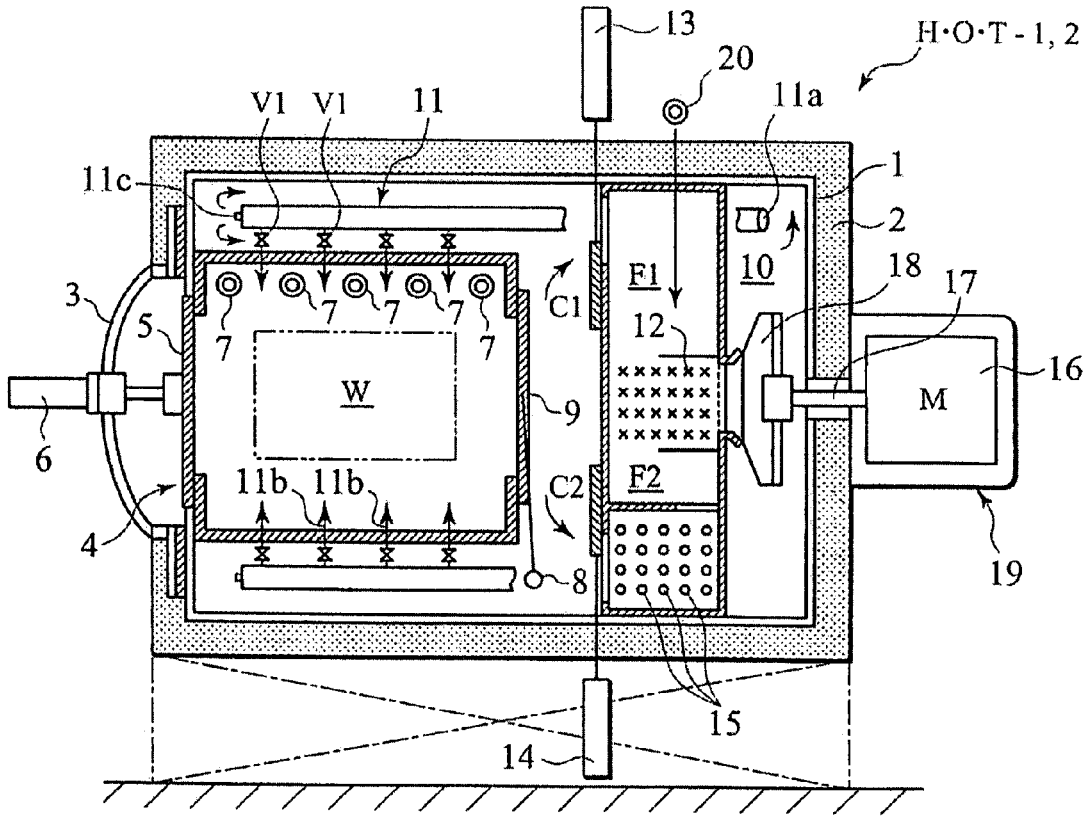
FIG. 1 is a vertical cross-sectional view showing a structure of hot-gas quenching apparatuses H•O•T-1 and H•O•T-2 according to an embodiment of the present invention.

A structure of hot-gas quenching apparatuses H•O•T-1 and H•O•T-2 according to an embodiment of the present invention is shown in FIG. 1. The hot-gas quenching apparatus of basic type H•O•T-1 and the hot-gas quenching apparatus of gas-preheated type H•O•T-2 look the same. Positions into which inert gas ($N_2$ gas) is introduced and control methods are different between the two hot-gas quenching apparatuses. With regard to the hot-gas quenching apparatus of basic type H•O•T-1, positions into which inert gas is introduced may be any of first and second ducts. However, with regard to the hot-gas quenching apparatus of gas-preheated type H•O•T-2, a position into which inert gas is introduced should be the first duct. The figure is shown citing an example of a case that inert gas is introduced into the first duct, in order that the figure can be adapted to either of the hot-gas quenching apparatuses H•O•T-1 and H•O•T-2.

A pressure container 1 needs to be constructed in order that the pressure container can withstand a pressure of 5 degrees Bar. The outer periphery of the pressure container 1 is heat-retained by a heat retaining material 2. The front (leftward in the figure) of the pressure container 1 is provided with a door 3 capable of being opened and closed.

A preheating furnace 4 constructed of a heat insulating material is arranged in a frontward position of the aforementioned pressure container 1. The inside of the preheating furnace 4 is assigned as a container of a workpiece W. A front window 5 of the preheating furnace 4 can be brought into close contact with a main body of the preheating furnace 4 by a cylinder actuator 6 provided to the door 3. The workpiece W is contained inside the preheating furnace 4.

In this example, the preheating furnace 4 contains a workpiece W, and heaters 7 preheat the workpiece. In some cases, workpieces which have been preheated are transferred from the outside. The preheating furnace 4 can be constituted as an atmosphere furnace or as a vacuum furnace. If the preheating furnace is intended to be a vacuum furnace, the preheating furnace should be constituted in order that a vacuum condition can be maintained in the inside of the pressure container 1. The rear of the preheating furnace 4 is provided with a rear window 9 capable of being opened and closed on a basis of a rotation of a pivot bar 8.

Inside the aforementioned pressure container 1, a circulation duct 10 is arranged for blowing inert gas onto the workpiece W contained in the aforementioned preheating furnace 4, and for circulating gas which has been blown. An air intake 11*a* of a distributor 11 is arranged in the circulation duct 10. A number of capillaries 11*b* provided with valves V1 are branched and connected to an outlet of the distributor 11. The capillaries are configured in order that the capillaries discharge gas to the workpiece W inside the aforementioned preheating furnace 4. An anterior extremity of a main pipe of the distributor 11 is provided with a pore 11*c*, and thereby a small amount of gas can be always discharged. This is for preheating, and holding, gas in the circulation duct 10 at an intermediate temperature.

In the middle of the circulation duct 10, a vertically located pair of ducts F1 and F2 are branched and constructed in order that inert gas flowing in the circulation duct 10 is made hot-gas. At the terminuses of both ducts F1 and F2, a mixer 12 is arranged for evenly mixing inert gas introduced from both ducts F1 and F2. The gas inlets of the ducts F1 and F2 are provided with respective control windows C1 and C2 capable of being opened and closed by cylinder actuators 13 and 14. Both windows C1 and C2 can be also operated continuously in a way that one of the two windows is opened while the other window is closed.

A water cooling unit 15 is arranged in the aforementioned second duct. In the figure, only water cooling pipes are illustrated. Water of a room temperature is transferred from an unillustrated water tank or the like to the illustrated pipes, and thereby the water cooling unit 15 cools inert gas flowing in the second duct F2 down to a room temperature. If a temperature of introduced gas is high, i.e. 500° C. or above as when a quenching is started, it is likely that a temperature of gas after passing through the water cooling unit 15 is 100° C. or above.

The aforementioned mixer 12 received gases of different temperatures from both ducts F1 and F2 respectively mixes the gases to an even temperature. To this end, for example, metal pieces or multiple partition plates are arranged, or an unillustrated screw for agitation or the like is arranged, inside the mixer 12 in order to mix both received gases. Gas introduced from the rear window 9 of the preheating furnace 4 is introduced from the outlet of the mixer 12 through both ducts F1 and F2. Inside the circulation duct 10, a temperature sensor for controlling a temperature and a gas pressure sensor for detecting gas pressure are arranged.

On the other hand, the rear extremity of the pressure container 1 is provided with a turboblower 19 for causing a dynamotor 16 to rotate and drive a rotating shaft 17 and for causing a fan 18 to pressurizing and outputting gas. Inert gas pressurized by the blower 19 is introduced to the air intake 11*a* of the distributor 11.

The rotating shaft 17 is structured so that an intermediate shaft constructed of a heat insulating material is provided to the middle of the rotating shaft 17, since hot-gas is inside the apparatus so that the inside is always at a high temperature. In addition, the outer periphery of the rotating shaft 17 is water-cooled, and thereby the rotating shaft 17 is structured so that heat is not easy to be conducted to the dynamotor 16. The dynamotor 16 is always caused to rotate at a low speed, and transfer inert gas to the main pipe of the distributor 11. The circulation duct 10 is always kept at a certain temperature by returned gas from the pore 11*c* provided to the extremity of the main pipe of the distributor 11. In addition, hot-gas can be blown onto a workpiece W by opening the valve V1 and by causing the motor 16 to rotate at a maximum speed. A tip portion of a gas introducing pipe 20 for introducing inert gas is opened to the first duct F1.

The hot-gas quenching apparatuses H•O•T-1 and H•O•T-2 having the above mentioned constitution look the same. The difference between the hot-gas quenching apparatuses H•O•T-1 and H•O•T-2 depends upon whether the preheating furnace is an atmosphere furnace or a vacuum furnace. Methods for controlling a pressure, a gas temperature, a flow amount and the like are also different.

First of all, in a case that the preheating furnace 4 is an atmosphere furnace, the hot-gas quenching apparatus H•O•T-1 is adapted. The preheating furnace 4 is an atmosphere furnace, and the circulation duct 10 can be also controlled at the same pressure. For this reason, the rear window 9 does not have to have a fully hermetic structure. Before a quenching is started, the blower 19 is caused to rotate slowly.

The temperature of gas in the circulation duct 10 is determined as an intermediate temperature which does not cause a workpiece W to be undercooled. This intermediate temperature is defined as a temperature $T_B$ slightly lower than an isothermal transformation temperature $T_A$.

Figure 2A:
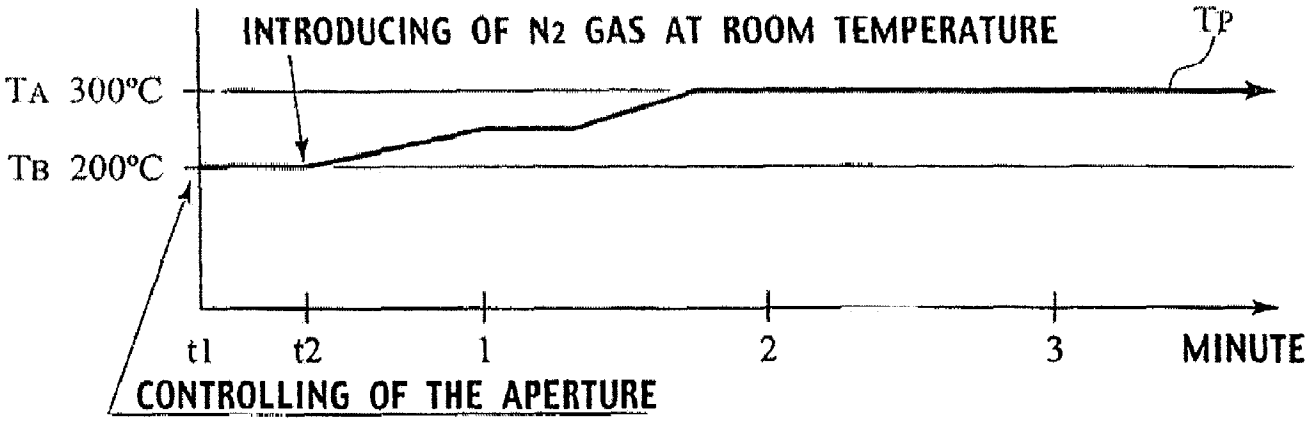
FIG. 2 is a temperature graph showing an outline of control of the hot-gas quenching apparatus H•O•T-1 of basic type.
Figure 2B:
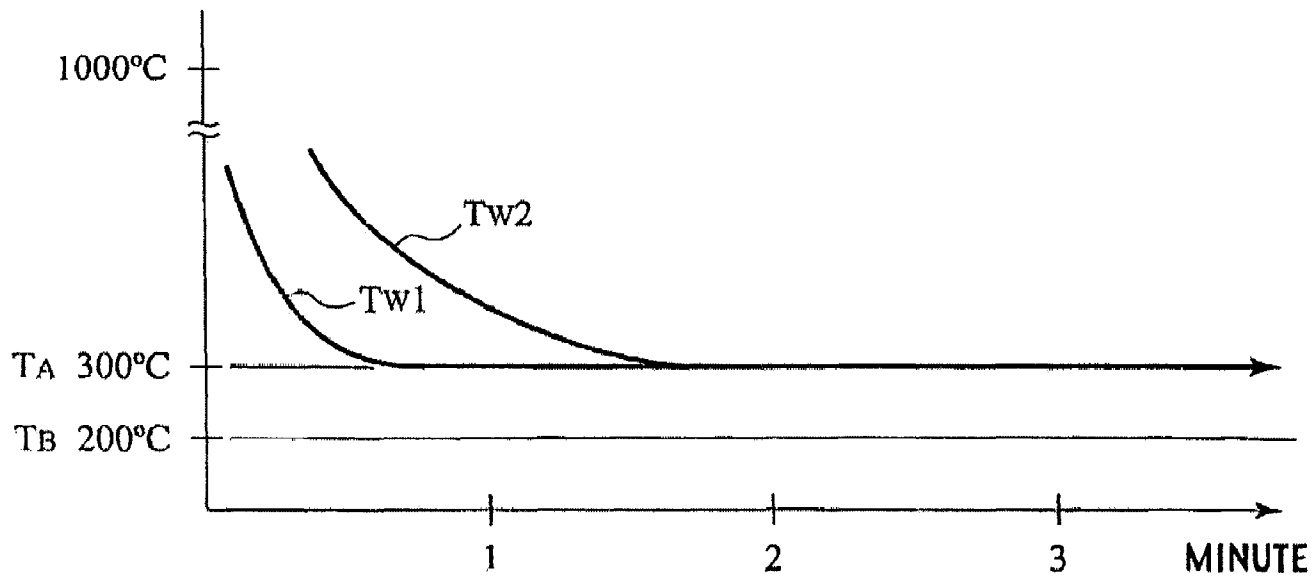

As shown in FIG. 2, with regard to the hot-gas quenching apparatus H•O•T-1 adapted to an atmosphere furnace, hot-gas, e.g. of 200° C., is circulated in the circulation duct 10 at a time tl when a quenching is started. It is assumed that the isothermal transformation temperature $T_A$ is 300° C. Once the quenching is started at a time t1, degrees of the opening of the control windows C1 and C2 are regulated, and subsequently the rear window 9 is opened. Accordingly, gas is flown into the mixer 12 through the ducts F1 and F2. The degrees of the opening of the control windows C1 and C2 is controlled in order that a temperature of gas in the circulation duct 10 is caused to be equal to a target temperature $T_P$ of controlling shown in FIG. 2(*a*).

In this case, inert gas of a room temperature starts to be introduced at a time t2 in order that a pressure of gas in the pressure container 1 is increased sequentially from a pressure, e.g. 2 degrees Bar, exerted while the atmosphere furnace 4 is used to a higher pressure, e.g. 5 degrees Bar. The times t1 and t2 are almost proximate.

An amount of introduced gas is determined in order that a temperature in the circulation duct 10 is caused to be equal to the target temperature $T_P$ while observing the temperature, and in order that the pressure does not exceed 5 degrees Bar. With regard to the workpiece W, as shown in FIG. 2(*b*), the surface (shallow portion) and deep portion of its material have different cooling lines Tw1 and Tw2 respectively. However, the workpiece W is cooled down to the isothermal transformation temperature $T_A$ gradually.

Once the workpiece W completes being evenly cooled down to the isothermal transformation temperature $T_A$, the control window C2 of the second duct is narrowed, and finally is closed. In this way, an isothermal holding can be performed.

Figure 3A:
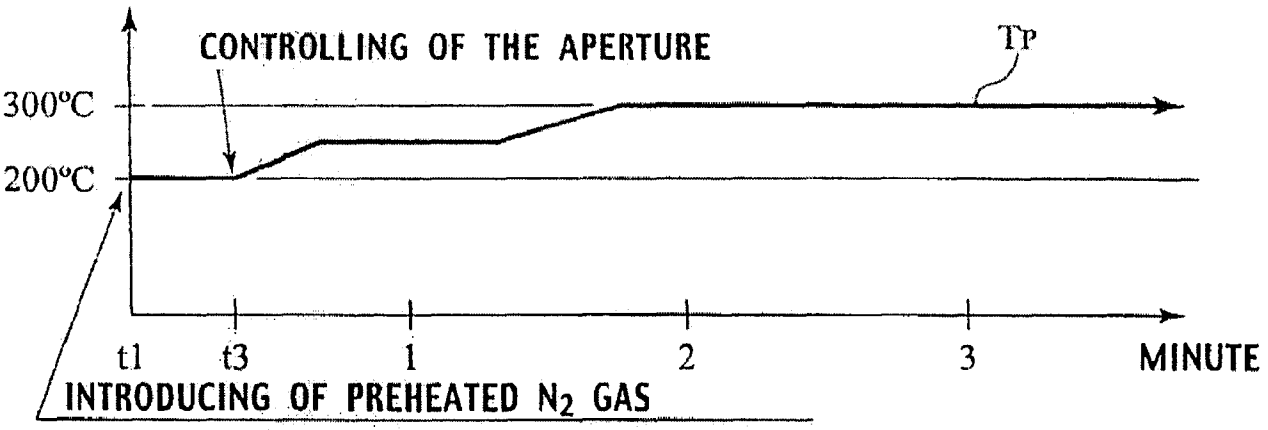
FIG. 3 is a temperature graph showing an outline of control of the hot-gas quenching apparatus H•O•T-2 of gas-preheated type.
Figure 3B:
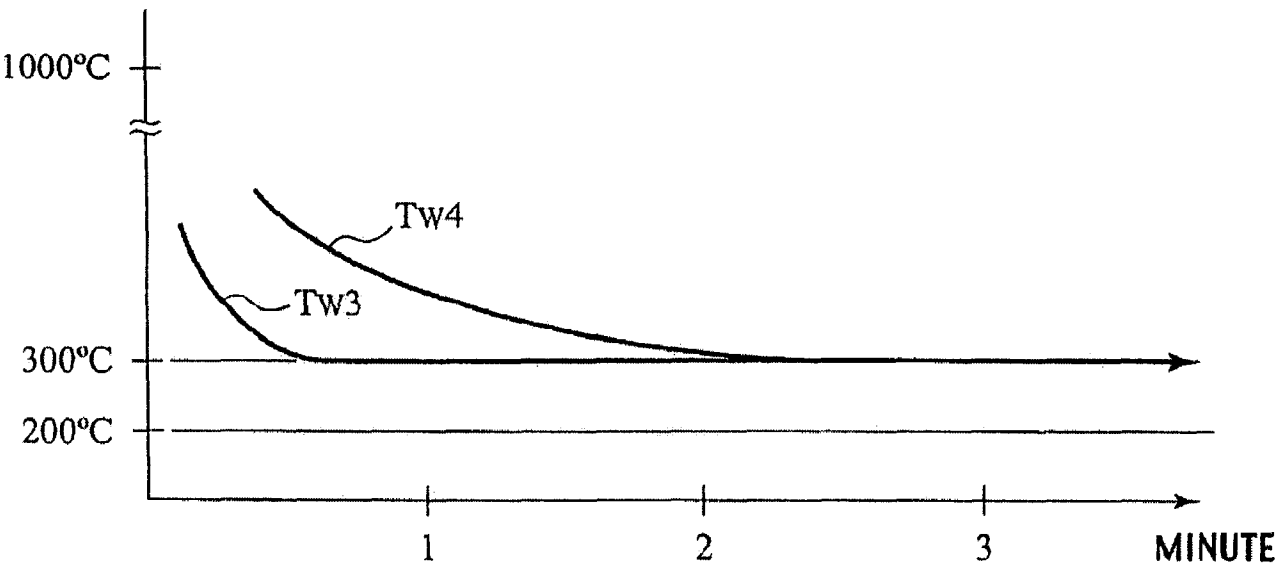

The hot-gas quenching apparatus of gas-preheated type H•O•T-2 to be adapted in a case that the preheating furnace 4 is a vacuum furnace is different from the hot-gas quenching apparatus of basic type H•O•T-1 in that preheated inert gas is blown in. In addition, the hot-gas quenching apparatus of gas-preheated type H•O•T-2 is different from the hot-gas quenching apparatus of basic type H•O•T-1 in that a time t3 when the control windows C1 and C2 are regulated is slightly delayed. As shown in FIG. 3, introduction of inert gas takes a slightly longer time because of creation of an atmosphere. For this reason, cooling curves Tw3 and Tw4 of the workpiece W are slightly delayed in progress compared to the proceeding example (Tw1 and Tw2). Once the atmosphere completes being created, progress of the cooling lines Tw3 and Tw4 after the completed creation of the atmosphere is similar to that of the proceeding example, i.e. the hot-gas quenching apparatus of basic type H•O•T-1.

Figure 4:
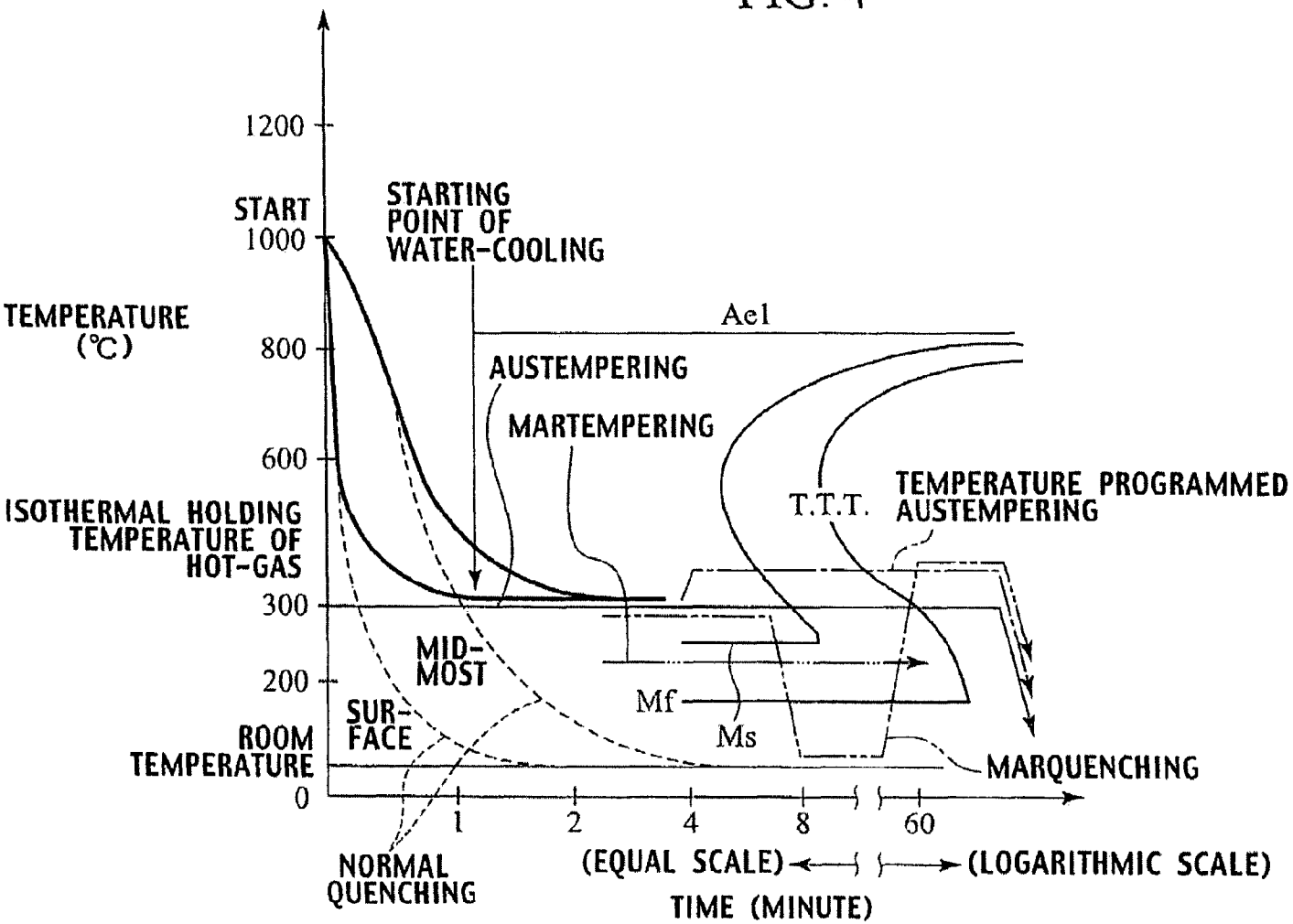
FIG. 4 is a time-temperature graph of a quenching showing an isothermal holding quenching method which can be performed by use of the hot-gas quenching apparatus according to the present invention.

FIG. 4 is a time-temperature graph of a quenching which can be performed by use of the hot-gas quenching apparatuses H•O•T-i (i=1 to 5) according to the present invention. In the figure, a broken line denotes time-temperature relations in a normal quenching; a solid line, time-temperature relations in an austempering; a chain line, time-temperature relations in a temperature programmed austempering; a two-dot chain line, time-temperature relations in a marquenching and time-temperature relations in a martempering.

With regard to the normal quenching denoted by the broken line, when an initial temperature to be applied when a quenching is started is, for example, 1,000° C., a workpiece is rapidly cooled down to a room temperature, and later the workpiece is tempered when deemed necessary. This method can be performed in a conventional blast furnace. The hot-gas quenching apparatuses H•O•T-i (i=1 to 5) of the present invention go to the extent of being capable of performing a tempering in the same furnace by use of an isothermal holding function.

With regard to an austempering, for example, a target temperature of an isothermal holding is set at 300° C. A workpiece has been cooled thereto by hot-gas of, for example, 250° C. before reaching a time corresponding to a stretched-out portion of an S curve (T, T, T curve), and is held isothermally thereat. In this way, the period in which the time-temperature relations form S curve has passed. Thereafter, the workpiece is cooled down to a room temperature.

With regard to a temperature programmed austempering, a target temperature $T_p$ is set at a temperature slightly lower than the aforementioned target temperature of 300° C., e.g. 250° C. After the surface and inside of a workpiece W come to be at the same temperature, the temperature is raised to the next target temperature of 300° C., and the workpiece is held isothermally thereat. After the period in which the time-temperature relations form S curve has passed, the workpiece is cooled down to a room temperature. The cooling down to a room temperature can be also performed outside the apparatus.

With regard to a marquenching, a workpiece W is held isothermally at a temperature slightly higher than a temperature denoted by a point Ms, and the workpiece W is quenched. Then, the workpiece W has been cooled at a cooling rate equivalent to that of air cooling before a time shown by a point at which a temperature line indicating the temperature slightly higher than the temperature denoted by the point Ms hits the S curve. Thence, the workpiece W is tempered. The air cooling can be also performed outside the apparatus.

With regard to a martempering, a workpiece is rapidly cooled to intermediate temperatures denoted by points Ms and Mf, and holds the workpiece isothermally. Thereby, a mixed composition of tempered martensite and lower bainite is formed. The workpiece W can be taken out of the furnace before the isothermal holding is completed, and can be tempered in another furnace.

As described above, according to the hot-gas quenching apparatuses H•O•T-i (i=1 to 5) of the present invention, a cooling can be performed freely at intermediate temperatures of 100° C. to 400° C., and an isothermal holding can be performed at the same temperatures. An error in temperature control can be confined to 5° C. to 10° C., and particularly an error in an isothermal holding can be confined to −1° C. to +1° C.

Figure 5:
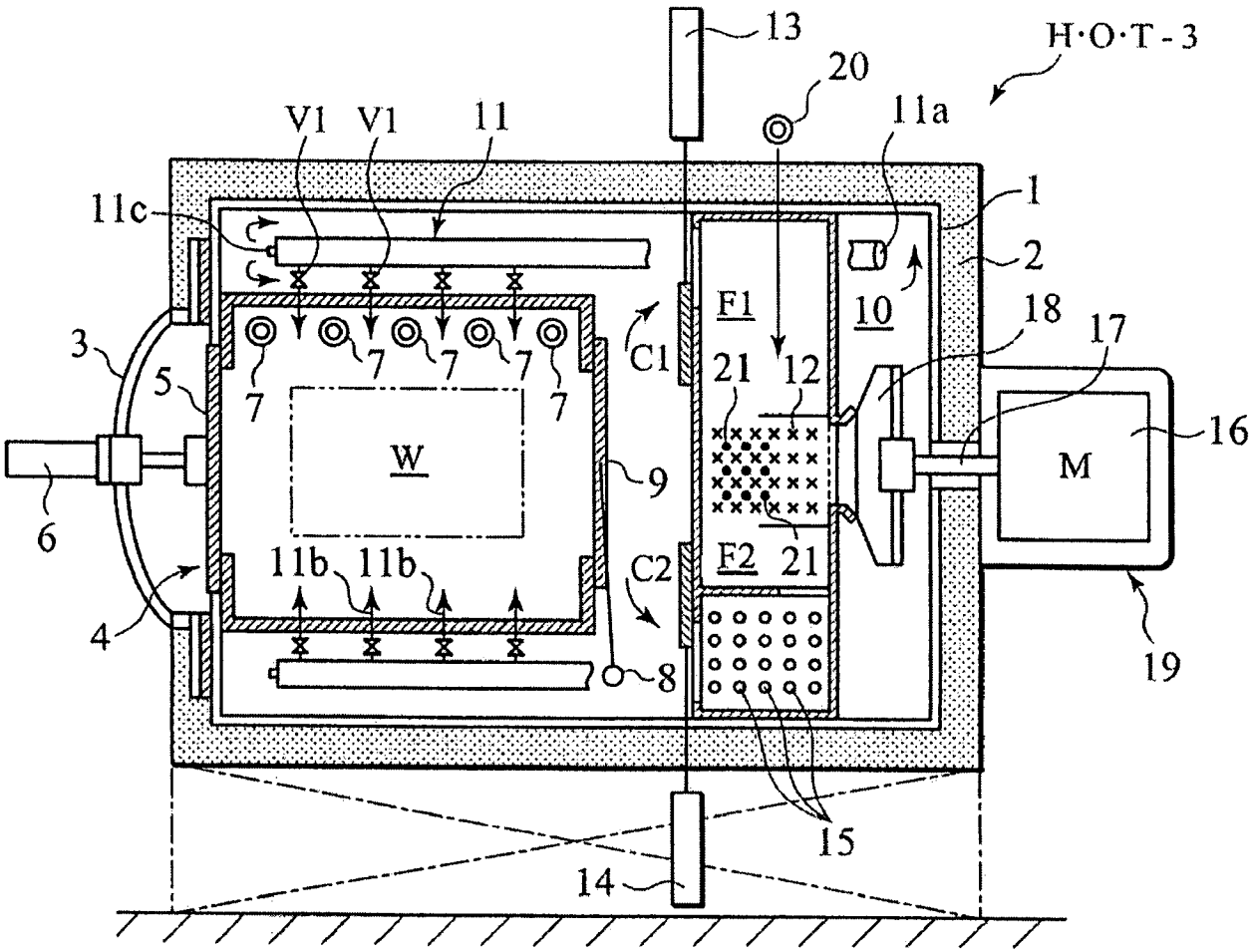
FIG. 5 is a vertical cross-sectional view showing a structure of a hot-gas quenching apparatus of contact-media-in-the-mixer type H O•T-3 according to the present invention.

FIG. 5 is a vertical cross-sectional view showing a structure of a hot-gas quenching apparatus of contact-media-in-the-mixer type H•O•T-3. Unlike the proceeding examples of the hot-gas quenching apparatuses H•O•T-1 and H•O•T-2, heat storage contact media 21, which is 0.3 times as much as a heat capacity of Qw of a workpiece W, is arranged in the mixer 12. With regard to the other members, members denoted by the same reference numerals perform the same or similar functions as the members in the proceeding examples.

As the contact media 21, a material of high air permeability such as a metallic ball of iron or aluminum, a metallic capillary, a metallic chip and the like can be used. In a case that a metallic capillary of 5 mm to 15 mm in diameter is used, the metallic capillary should be used in a way that the direction of the through hole of the capillary agrees with the direction of flowing gas. The contact media 21 are preheated to an intermediate temperature before a quenching is started. By contacting these contact media 21 to inert gas, the temperature of the inert gas can be promptly converted to the temperature of the contact media 21, and thereby the inert gas can be blown onto the workpiece W through the distributor 11.

An amount of the contact media 21 arranged in the mixer 12 is, for example, 300 kg for each 1 ton of a workpiece W. For this reason, an equilibrium temperature can not be defined as a target temperature because of the relations shown in Table 2. However, the temperature of inert gas of a high temperature can be instantaneously cooled down to the temperature of the contact media 21, when a quenching is started. Consequently, by setting the temperature of the contact media at an initial target temperature shown in FIGS. 2 and 3, for example, 200° C., inert gas introduced or atmospheric inert gas can be blown onto the workpiece W at 200° C. at least in an initial period. In other words, a large amount of inert gas can be introduced instantaneously, and accordingly a rapid cooling rate can be enhanced. Then, since control windows C1 and C2 are controlled and thereby the gas is cooled, a temperature control similar to that shown in FIGS. 2 or 3 can be performed. Stability of temperature control can be also enhanced by using the contact media 21.

Figure 6:
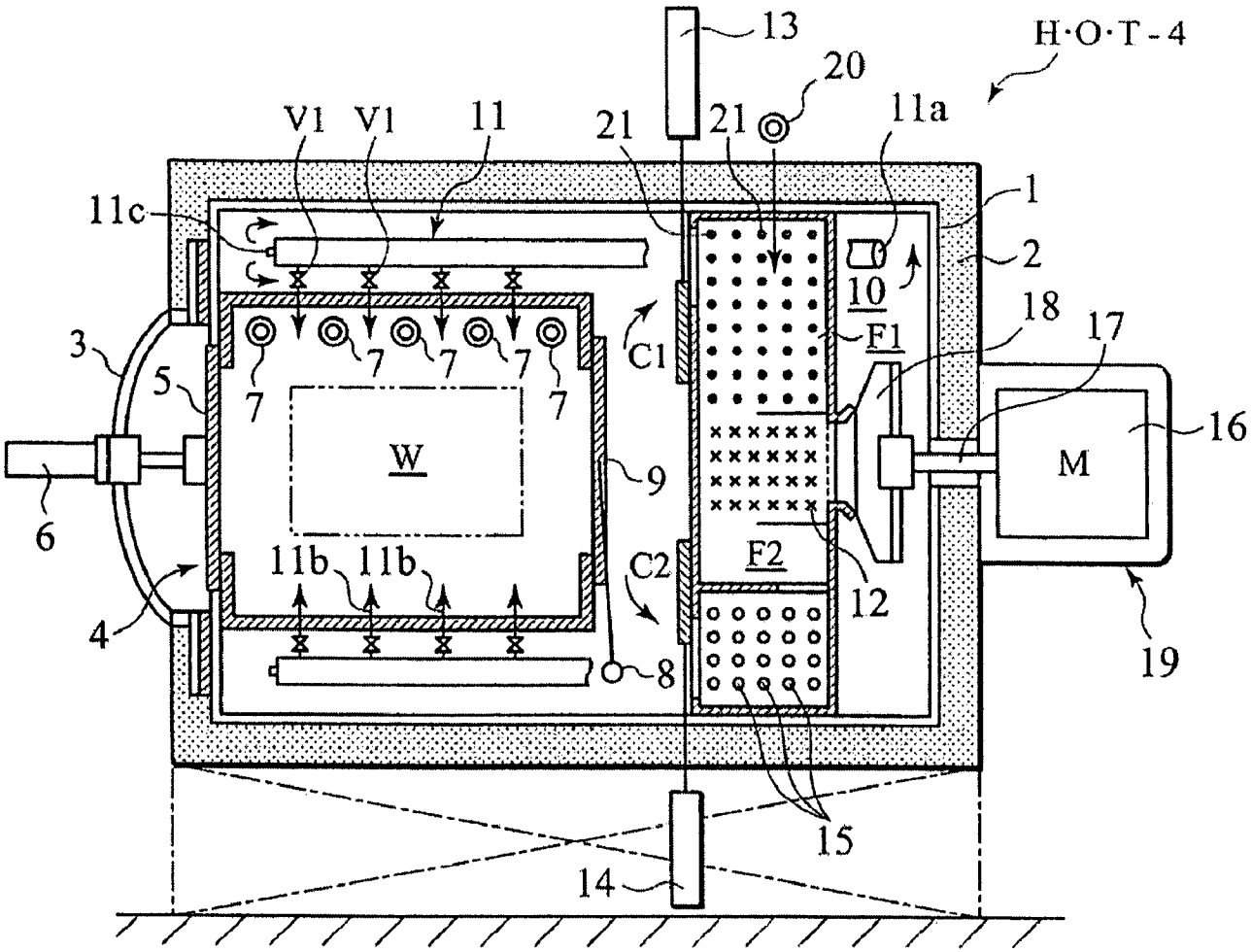
FIG. 6 is a vertical cross-sectional view showing a structure of a hot-gas quenching apparatus of contact media-in-the-duct type H•O•T-4 according to the present invention.

As shown in FIG. 6, with regard to the hot-gas quenching apparatus contact media-in-the-duct type H•O•T-4 of the present invention, contact media 21 are arranged in a first duct F1. The other members are the same as those shown in FIGS. 1 and 5. The members having the same functions as shown in FIGS. 1 and 5 are denoted by the same reference numerals. The contact media 21 are not arranged in a mixer 12, but the contact media 21 can be arranged in the mixer 12, too.

An amount of the aforementioned contact media 21 is set with reference to Table 2. In other words, in a case that, for example, steel balls are used as the contact media 21, the amount of the contact media is determined as 1.0 times as much as the weight of the workpiece W.

Figure 7:
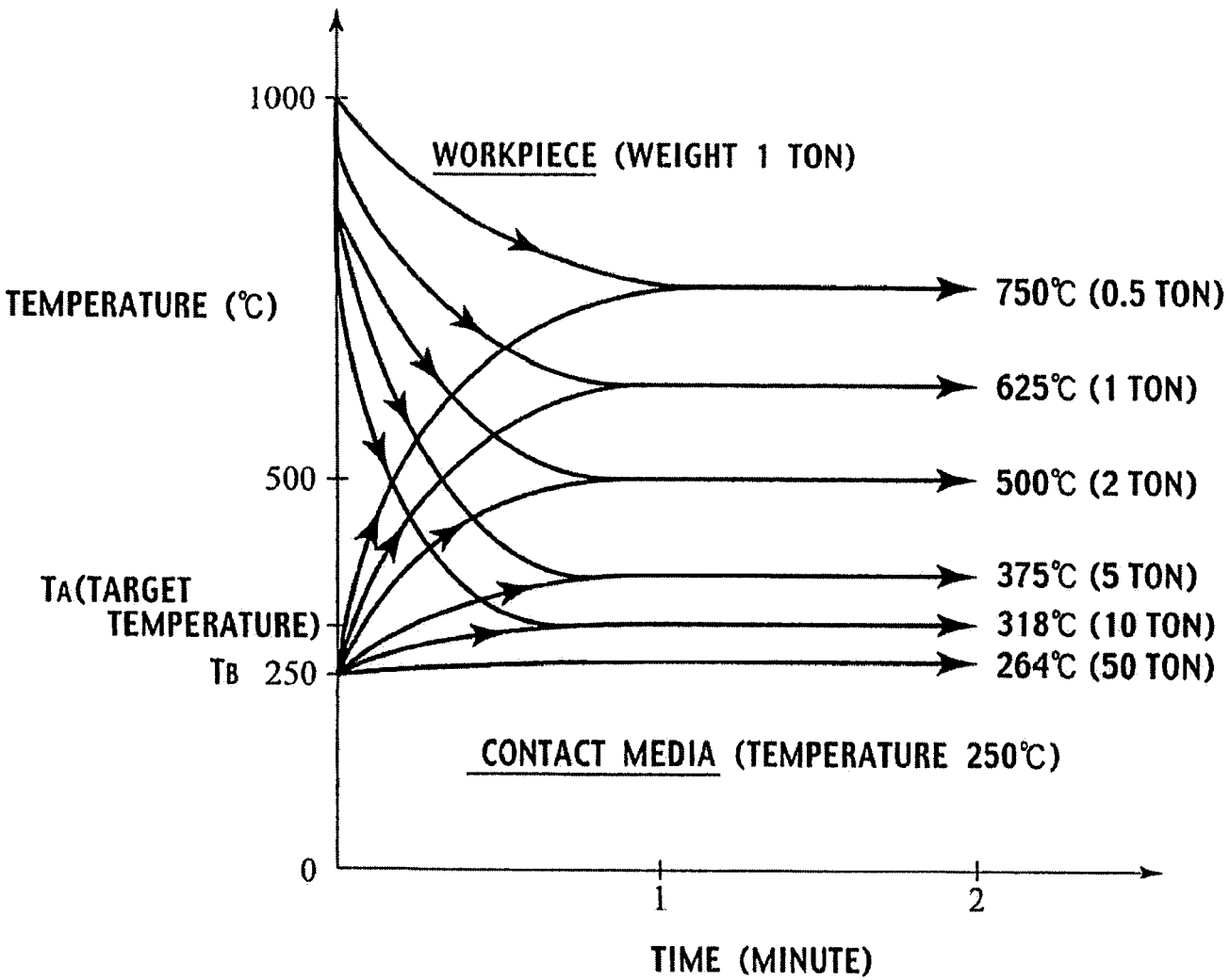
FIG. 7 is a graph showing equilibrium temperatures of a workpiece and contact media in a circulation duct.

FIG. 7 is a time-temperature graph showing characteristics to be exhibited in a case that temperature equilibrium of a workpiece W and contact media 21 is performed in a circulation duct 10 under conditions shown in Table 2. As shown in the figure, if the temperature of the contact media 21 is 250° C. and a target temperature $T_P$ of an isothermal holding is 300° C., when the contact media 21 weighs 1 ton as the workpiece W does, the contact media 21 can absorb a heat by 325° C. In other words, when hot-gas is blown onto the workpiece W, the temperature of the hot-gas rises and the pressure thereof increases. In this way, the hot-gas flows to the circulation duct 10. At this time, the gas whose temperature has risen is cooled by the contact media 21. While observing the pressure, a valve of a $N_2$ gas introducing pipe 20 is regulated, and the pressure is maintained at 3 to 5 degrees Bar. Thereby, a control window C2 of a second duct F2 is opened gradually, and the gas is cooled in order that the temperature of the circulated gas is equal to the final target temperature. Through these processes, the temperature of hot-gas can be caused to be equal to 300° C., for example, and the temperature of the workpiece W can be caused to be equal to the target temperature. Thereafter, an isothermal holding can be performed.

Figure 8:
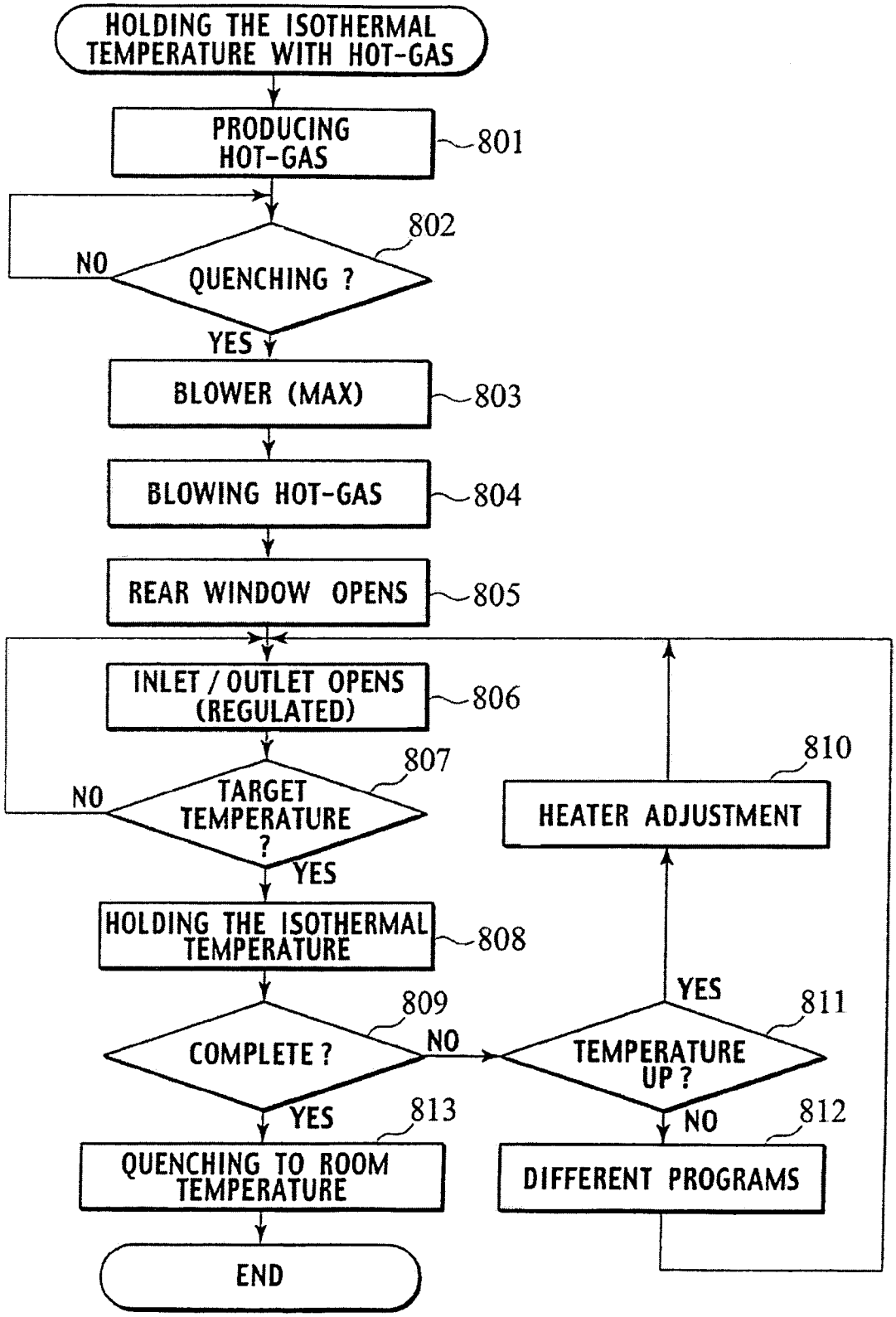
FIG. 8 is a flowchart showing an outline of control of the hot-gas quenching apparatus H•O•T-4.
Figure 9:
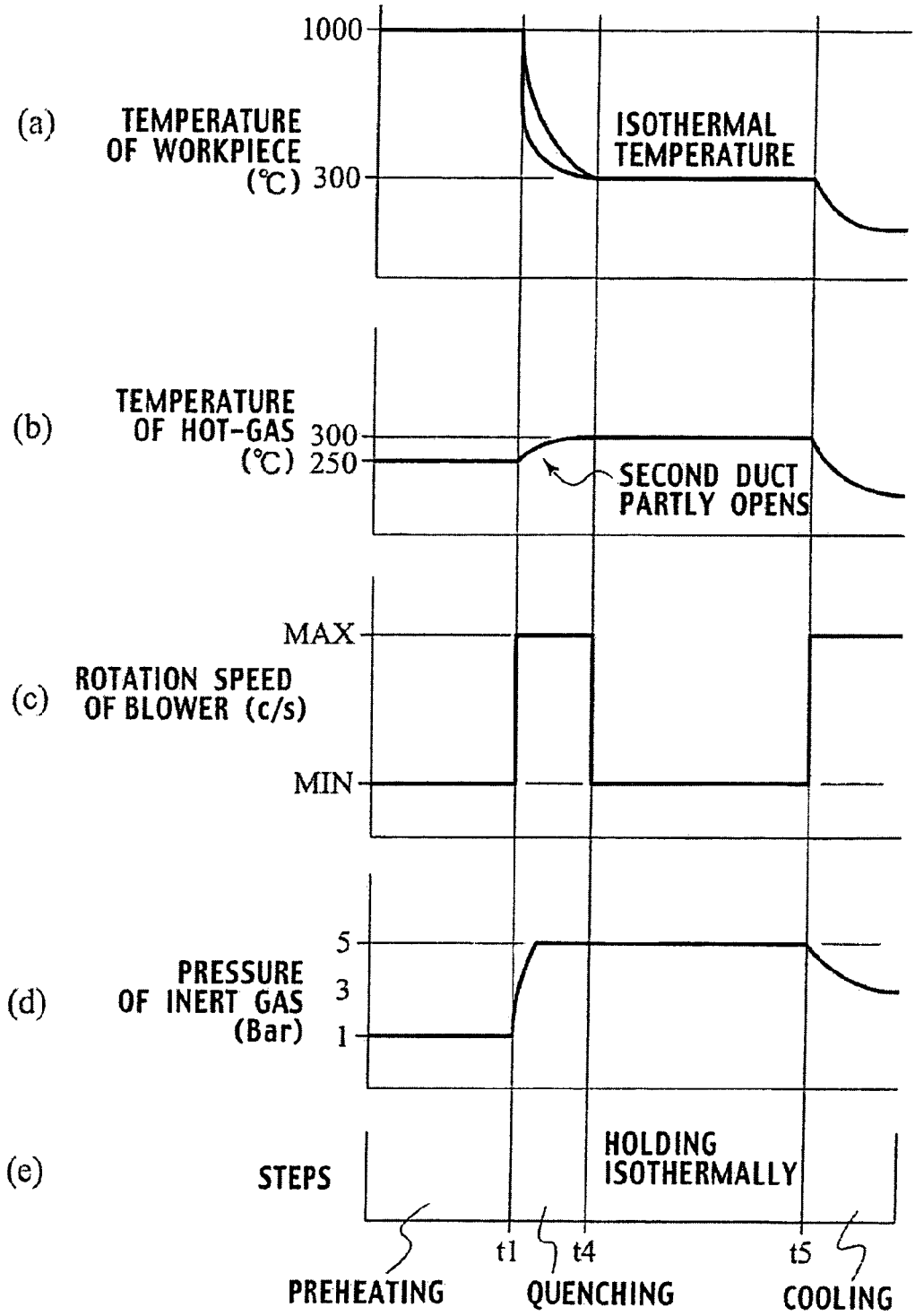
FIG. 9 is a time charts showing various changes and operations to be obtained by control shown in FIG. 8.

An outline of control of the hot-gas quenching apparatus H•O•T-4 according to the present invention is collectively shown in FIGS. 8 and 9. It is assumed that a workpiece W and contact media 21 weigh 1 ton each. In addition, it is assumed that the target temperature of an austempering is 300° C., and that the intermediate temperature which does not cause an undercooling is 250° C. In FIG. 8, the temperature of the contact media 21 in the circulation duct 10 is caused to be 250° C., and hot-gas is produced in step 801. The control of the hot-gas quenching apparatus H•O•T-4 proceeds to quenching steps after step 802 is performed. As shown in FIG. 9(*c*), a blower 19 can change the rotation speed when deemed necessary. In order to heat the contact media 21, the temperature of atmospheric gas can be used. However, an unillustrated heater can be used, too.

In step 803, the blower 19 is caused to drive at a high speed. In step 804, a valve V1 of a distributor 11 is opened to blow hot-gas onto the workpiece W. At this time, a rear window 9 is opened in step 805.

In steps 806 to 811, while observing the temperature of the hot-gas, the control windows C1 and C2 and an unillustrated heater are controlled, and an isothermal holding at the target temperature is performed. The control of the hot-gas quenching apparatus H•O•T-4 can jump to different programs for changing the target temperature and doing other things after step 812 is performed. In step 813, a process for cooling down to a room temperature is performed. When a transition to an isothermal holding process is made, the workpiece can be transferred to another furnace. Thereby, the inside of the apparatus can be always maintained at the temperature of the hot-gas. This is preferable, since this reduces heat loss and does not change the temperature of the internal structure to a large extent.

As shown in FIG. 9, according to the hot-gas quenching apparatus H•O•T-4 according to the embodiment, an isothermal holding can be preformed with precision from a time t4 through a time t5, both of which come after a time t1 when the quenching is started. The isothermal holding can be performed with an error in temperature of less than several degrees Celsius. FIG. 9(*a*) shows temperatures of the workpiece W; FIG. 9(*b*), a change in temperature of the hot-gas; FIG. 9(*c*), a change in rotation speed of the blower 19; FIG. 9(*d*), a change in pressure of the inert gas; and FIG. (*e*), steps of preheating, quenching, holding isothermally and cooling. The steps can include steps of heating and tempering.

As described above, according to the hot-gas quenching apparatus H•O•T-4 of the present invention, the contained workpiece W can be rapidly cooled, and held isothermally, by the hot-gas which has been produced by use of the contact media 21. In addition, the workpiece W can be heated freely. Thereby, it goes without saying that an austempering can be performed. Furthermore, a marquenching, a martempering and the like can be performed in a single furnace. Although a precision in control is different, other hot-gas quenching apparatuses H•O•T-1, H•O•T-2 and H•O•T-3 also can do the same things. Since the temperature control is performed by hot-gas without a salt bath, the temperature control can be performed safely, freely, and with high precision. Metal products can be heat-treated in accordance with theories and with high quality.

Figure 10:
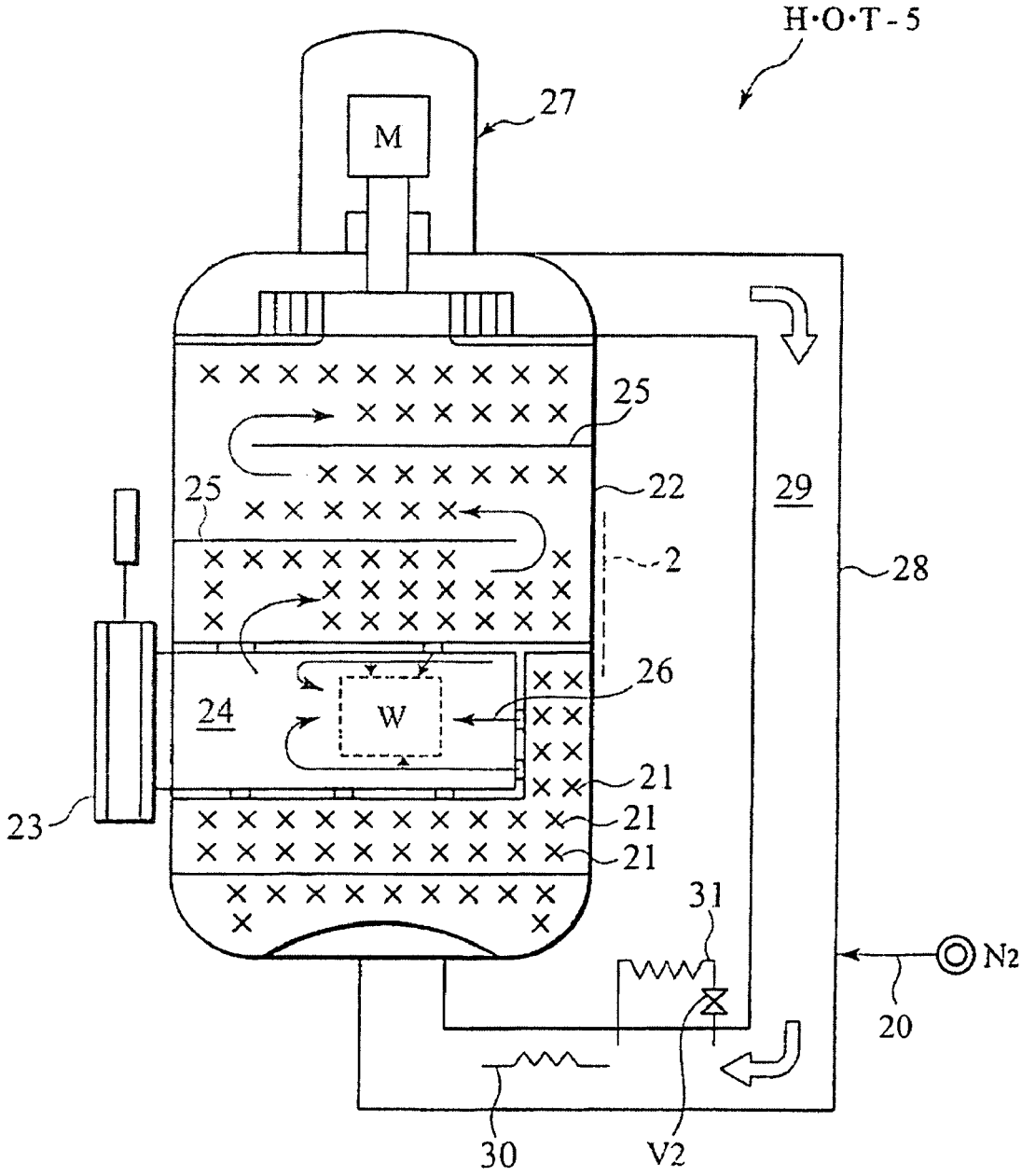
FIG. 10 is a vertical cross-sectional view showing an embodiment of a hot-gas quenching apparatus of crucible type H•O•T-5 (H•O•T•R) according to the present invention.

FIG. 10 is a vertical cross-sectional view showing an embodiment of a hot-gas quenching apparatus of crucible type H•O•T-5. A side surface of a pressure container 22 shaped like a vertical cylinder is provided with a partition window 23 through which to put a workpiece W into, or out of, the pressure container 22. The inside of the pressure container 22 is provided with a container 24 for containing the workpiece W.

The interior of the pressure container 22 is partitioned by a plurality of partition plates 25 in a way that the partition plates 25 alternately extend to the middle of the interior of the pressure container 22 horizontally in stacks from the bottom to the top. In this manner, a duct is constructed. In the duct, contact media 21 similar to the aforementioned contact media are filled. A distributor 26 is arranged in the duct near the container 24. The interior of the pressure container 22 is configured so that gas entering a lower portion of the duct corresponding to a lower part of the figure is blown onto the workpiece W with the distributor 26, and thereafter is returned to an upper portion of the duct.

The top of the pressure container 22 is provided with a blower 27 which is an equivalent to the blower shown in FIG. 1. Gas pressurized by the blower 27 is transferred from the top to the bottom through a duct 28. The blower 27 along with the duct constitutes a circulation duct 29. Parts of the duct 28 are provided with a gas introduction pipe 20 through which to replenish inert gas, a heater 30 for temperature regulation, and a cooling unit 31 respectively. The cooling unit 31 is configured to extract part of gas from the circulation duct 29 through a valve V2, and to cool the extracted gas by use of a water pipe, thereafter returning the cooled gas to the circulation duct 29. The pressure container 22 and the duct 28 are heat-retained by use of heat-retaining material 2 on the outer periphery of the pressure container 22 and the duct 28.

An amount of the contact media 21 is set, for example, at 10 tons to 30 tons, with reference to Table 2 and FIG. 7, assuming, for example, that a workpiece of 1 ton in weight is cooled down to a target temperature of 300° C. and is held thereat only by the contact media 21. An amount (volume) of contact media 21 needed is determined as shown in the following Table 3, if the contact media 21 are steel balls. This is because, when the specific gravity of iron is 7.9 g/cm$^3$, the apparent specific gravity of a steel ball is 4.14 g/m$^3$.

TABLE 3

| STEEL BALL CONTACT MEDIA VOID: 47.6% | |
|---|---|
| WEIGHT | VOLUME |
| 5 ton | 1.2 m$^3$ |
| 10 ton | 2.4 m$^3$ |
| 20 ton | 4.8 m$^3$ |
| 30 ton | 7.2 m$^3$ |
| 50 ton | 12.1 m$^3$ |

It is learned through Table 3 that 10 tons to 30 tons of the contact media is a practical value when the workpiece weighs 1 ton. When the workpiece weighs 100 kg, one tenths of the 1 ton of the contact media is enough to accommodate the 100 kg of the workpiece.

A description will be provided for an operation of the hot-gas quenching apparatus H•O•T-5. Let's assume that a workpiece W preheated, for example, to 1,000° C. has just been placed in the container 24 through the partition window 23. It is assumed that the contact media 21 are preheated to a temperature equal to the temperature of the hot-gas, for example, 250° C.

Once the workpiece W is placed in, the blower 27 is caused to rotate at a high speed, and thereby hot-gas is blown onto the workpiece W through the distributor 26. Although the pressure rises, the pressure can be easily controlled in a way the pressure is within a range of 3 degrees Bar to 5 degrees Bar, since a large amount of the contact media 21 are used. In other words, the temperature of the hot-gas is 250° C. in an initial period. If the contact media 21 weigh 10 tons in terms of a volume-to-weight conversion, the equilibrium temperature is 318° C. with reference to Table 2. If a target temperature is defined as 300° C. and the temperature is intended to be controlled so as to maintain the temperature at 300° C. exactly, a heat quantity equivalent to 180° C. may be removed by a cooling unit 31, or the temperature of the hot-gas, i.e. the temperature of the contact media 21 may be set at 232° C. by decreasing the temperatures of the contact media 21 by 18° C. If the contact media 21 weigh 20 tons in terms of a volume-to-weight conversion, the temperature of the hot-gas is 296° C. with reference to Table 2. The initial temperature may be set at 254° C. by increasing the temperature of the contact media 21 by 4° C. A temperature drop during an ensuing isothermal holding is approximately 1° C. For this reason, the heater 30 does not have to be operated. In the above described manner, a rapid cooling and an isothermal holding can be performed with extremely high precision.

As described above, the hot-gas quenching apparatus H•O•T-5 according to the present invention can cool the placed workpiece W rapidly, and can hold the workpiece W isothermally at a constant temperature. In addition, the hot-gas quenching apparatus H•O•T-5 can receive a workpiece W which has been cooled down to the temperature of hot-gas, and can do nothing but hold the workpiece W isothermally. Consequently, in heat treatments, including various isothermal holdings shown in FIG. 4 the hot-gas quenching apparatus H•O•T-5 can be used for a rapid cooling, part of an isothermal holding, or all the processes, and can perform a metal heat treatment of high quality.

The container 24 can be arranged in the duct 28. In addition, a plurality of hot-gas quenching apparatuses H•O•T-5 for each of different temperatures, for example, 150° C., 200° C., 250° C. and 300° C. can be arranged, and can be utilized for an optional heat treatment by a sequential or selective use. In this sense, the hot-gas quenching apparatuses H•O•T-5 of the present invention can be called a "hot-gas crucible" in the place of a conventional salt bath. Unlike the salt bath, the hot-gas quenching apparatuses H•O•T-5 is safe, and does not require the immersing of a workpiece or the picking up of it. Thus, the hot-gas quenching apparatuses H•O•T-5 is extremely easy to use. When 10 tons of contact media 21 is used, the volume is 2.4 m$^3$. Accordingly, the hot-gas quenching apparatus H•O•T-5 is not a so large apparatus. When he hot-gas quenching apparatuses H•O•T-5 is used exclusively for an isothermal holding, this apparatus can be called a hot-gas isothermal holding apparatus H•O•T•R.

A vacuum furnace, or an atmosphere furnace (not illustrated), which has the preheating function as the preheating furnace 4 shown in FIG. 1 does, can be connected directly to the partition window 23. In this case, a workpiece W which has been preheated by the preheating furnace 4 can be put into the container 24 by opening the partition window 23, and can be cooled and quenched, and held isothermally.

Figure 11:
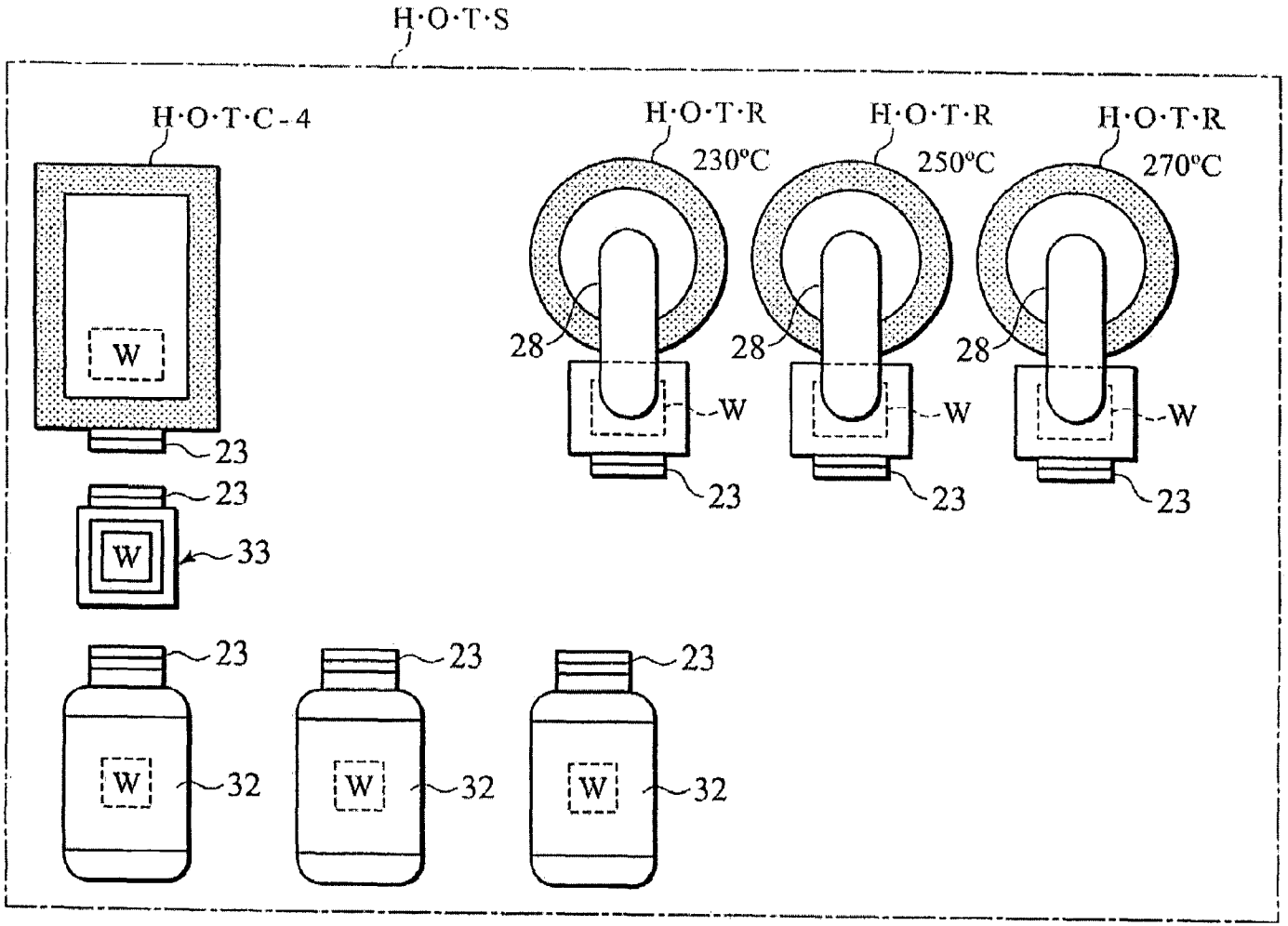
FIG. 11 is a planar view showing a structure of a hot-gas heat treatment system H•O•T•• S according to an embodiment of the present invention.

FIG. 11 is a planar view showing a constitution of a hot-gas heat treatment system H•O•T•S configured of 3 preheating furnaces 32, 1 hot-gas quenching apparatuses H•O•T-4, 3 isothermal holding apparatus H•O•T•R. The hot-gas quenching apparatuses H•O•T4, is the same as the quenching apparatus shown in FIG. 6, except that a partition window 23 is used for the hot-gas quenching apparatus H•O•T-4. The hot-gas isothermal holding apparatus H•O•T•R is the same as the isothermal apparatus shown in FIG. 10. In the hot-gas isothermal holding apparatus H•O•T•R according to the embodiment, a workpiece container 24 is arranged in a duct 28.

In FIG. 11, the preheating furnaces 32 can preheat a workpiece W. The hot-gas quenching apparatus H•O•T-4 can receive the preheated workpiece W, and can perform various quenching methods shown in FIG. 4. The hot-gas isothermal holding apparatus H•O•T•R is preheated to a predetermined temperatures, for example, 230° C., 250° C. and 270° C., and can cool down the received workpiece W to a target temperature, for example, 300° C., and hold the workpiece isothermally thereat. In addition, the hot-gas isothermal holding apparatus H•O•T•R can isothermally hold a workpiece W, which has been cooled rapidly, at a constant temperature, and can temper the workpiece. A workpiece transferring robot 33 is a robot which heat-retains a workpiece W at a constant temperature in vacuo or in a gas atmosphere and transfers the workpiece from one furnace to another.

By constructing a tunnel including workpiece moving means by use of workpiece transferring, temperature retaining, or heat retaining means, gas pressure regulator means, roller devices and the like, the hot-gas heat treatment system H•O•T•S-1 can be configured so that a plurality of preheating furnaces 32 and one or a plurality of hot-gas quenching apparatus H•O•T-i are connected to each other. Or else, the hot-gas heat treatment system H•O•T•S-1 can be configured so that various apparatuses are connected to a workpiece station, and so that one or a plurality of workpieces W can be subjected to various heat treatments.

As the hot-gas heat treatment system H•O•T•S, there are a variety of embodiments, in addition to the aforementioned embodiment. For example, there is a configuration where a workpiece station capable of transferring a workpiece is placed in the middle, and where a preheating furnace and a hot-gas quenching apparatus or an isothermal holding apparatus are placed around the workpiece station and are connected to the workpiece station. In addition, there is a configuration where a plurality of preheating furnaces, each of which has different preheating temperatures, are connected in series, and then a hot-gas quenching apparatus H•O•T-i is connected to the preheating furnaces, and thence a plurality of isothermal holding apparatuses H•O•T•R are connected in parallel thereto.

In such a way, various types of systems can be configured in various manners, with the hot-gas quenching apparatus H•O•T-i according to the present invention used as a core. Accordingly, a highly efficient and high quality heat treatment can be performed.

A plurality of isothermal holding furnaces H•O•T•R-i having different temperatures may be connected by use of an air channel, and thereby hot-gas of a selected isothermal holding furnace H•O•T•R-i may be blown onto a workpiece W placed in the air channel. By doing this, an optional temperature can be chosen adequately. In addition, energy conservation and resource saving can be achieved, since contact media 21 of the isothermal holding furnace H•O•T•R-i, which are cooled naturally sequentially, are used by heating.

As is clearly understood by the above examples, a hot-gas metal heat treatment method according to the present invention not only can be used by use of the above described apparatuses and systems instead of a conventional salt bath method, but also can perform a more dynamic control for an isothermal holding. Since the hot-gas metal heat treatment method is excellent in dynamic characteristics, the method does not require labor or time for workpiece of salt bath changing, and performance of tracking is excellent so that an optional temperature can be designed.

In addition, the hot-gas metal heat treatment method has an advantage that, when a metal heat treatment method through an isothermal holding which has not been invented is established, the established method can be carried out quickly. For example, the hot-gas metal heat treatment method according to the present invention can change a temperature piece by piece. In addition, a temperature can be changed up and down freely. According to the hot-gas metal heat treatment method according to the present invention, a heat treatment method can be carried out in a small facility safely and efficiently by use of a metal heat treatment by various isothermal holdings and hot-gas instead of a conventional salt bath method. In addition, since a control for change in temperature can be performed easily, quickly and freely, the hot-gas metal heat treatment method according to the present convention can be free from restrictions by a conventional salt bath method, the method according to the present convention can perform a dynamic isothermal holding in addition to a static isothermal holding. The dynamic means quickly, and freely to change. For example, a precise, dynamic control according to a design can be performed in a way that 300° C. is maintained for 10 minutes, 315° C. is maintained for 20 minutes, and 305° C. is maintained for 30 minutes.

Furthermore, various heat treatment methods such as an austempering, a martempering, a marquenching and the like which are to be performed by a conventional salt bath can be improved. Also, the hot-gas metal heat treatment method according to the present invention can be a foundation on which a metal heat treatment method by a yet efficient isothermal holding can be proposed.

It should be noted that the present invention is not limited to the aforementioned embodiments, and that the present invention can be modified in terms of a design when deemed necessary within a scope of the present invention. It goes without saying that the present invention can be embodied in various modes.

Contents disclosed in the application of the present invention are concerned with inventions included in Japanese Patent Application No. 2001-325248 applied on Oct. 23, 2001, Japanese Patent Application No. 2002-039955 applied on Feb. 18, 2002, Japanese Patent Application No. 2002-084230 applied on Mar. 25, 2002, and Japanese Patent Application No. 2002-170194 applied on Jun. 11, 2002. Accordingly, these Japanese Patent.

According to the hot-gas metal heat treatment method of the present invention, a heat treatment method can be carried out in a small facility safely and efficiently by use of a metal heat treatment by various isothermal holdings and hot-gas instead of a conventional salt bath method. In addition, since a control for change in temperature can be performed easily, quickly and freely, the hot-gas metal heat treatment method according to the present convention can be free from restrictions by a conventional salt bath method, the method according to the present convention can perform a dynamic isothermal holding in addition to a static isothermal holding.

Furthermore, various heat treatment methods such as an austempering, a martempering, a marquenching and the like which are to be performed by a conventional salt bath can be improved. Also, the hot-gas metal heat treatment method according to the present invention can be a foundation on which a metal heat treatment method by a yet efficient isothermal holding can be proposed.

The hot-gas quenching apparatus of basic type according to the present invention comprises the first (for higher temperatures) and the second (for lower temperatures) ducts, and controls the temperature of gas flowing in the circulation duct to an intermediate temperature determined in relation to an isothermal transformation temperature by regulating an opening degree of the control window provided to each duct. Consequently, a workpiece in an inert gas atmosphere can be cooled to the intermediate temperature rapidly, and can be held isothermally at the isothermal transformation temperature for an optional length of time with high precision.

The controller may control an opening degree of the control window provided to each duct in order that the outputted temperature of the mixer is equal to the intermediate temperature. In addition, an amount of inert gas of a room temperature, which are additionally introduced into an inert gas atmosphere may be controlled in order that the pressure of cooled gas is equal to a required gas pressure, for example, 5 degrees Bar. The preheating of the inert gas is not necessary, except in a case that a vacuum furnace is used.

The hot-gas quenching apparatus of gas-preheated type according to the present invention comprises the first and second ducts as well as the mixer provided to the terminus of each duct. Furthermore, the control windows provided to the first and second ducts are regulated in order that the outputted temperature of the mixer is equal to an intermediate temperature while introducing inert gas preheated to the intermediate temperature. Consequently, even if a workpiece is contained in vacuo, the workpiece can be cooled to the intermediate temperature rapidly, and can be held isothermally at an isothermal transformation temperature.

With regard to the hot-gas quenching apparatus of contact-media-in-the-mixer type according to the present invention, contact media having heat capacity are arranged in the mixer compared to the hot-gas quenching apparatus of basic type. Consequently, atmospheric inert gas or introduced inert gas when a quenching is started can be changed to the temperature of the contact media, i.e. an intermediate temperature, quickly. Subsequently, the same control as the hot-gas quenching apparatus of basic type performs may be performed in order that the temperature of the inert gas is equal to the intermediate temperature. Accordingly, a speed of a rapid cooling is high, and stability is excellent.

With regard to the hot-gas quenching apparatus of contact media-in-the-duct type according to the present invention, required heat storage contact media is arranged in the first duct compared to the hot-gas quenching apparatus of basic type. Consequently, contact media which are several times as much as contact media in the hot-gas quenching apparatus of contact media-in-the-duct type can be arranged therein. By arranging a required amount of contact media in the first duct, a cooling to an intermediate temperature can be performed with high performance of tracking, even if a large amount of gas is used, and an easy, quick and reliable cooling to the intermediate temperature can be performed. Furthermore, a stability of temperature during an isothermal holding is excellent.

With regard to the hot-gas quenching apparatus of crucible type according to the present invention, a large amount of heat storage contact media is arranged in the circulation duct. Consequently, the cooling of a workpiece to an intermediate temperature rapidly can be performed by gas circulation only. As an isothermal holding apparatus, furthermore, the hot-gas quenching apparatus of crucible type can be used exclusively for an isothermal holing.

The hot-gas heat treatment system according to the present invention can perform an intermittent or continuous isothermal holding heat treatment extremely efficiently by combining one or a plurality of various hot-gas quenching apparatuses above mentioned as well as another preheating furnace and the like by use of the workpiece transferring robot, the workpiece station or the tunnel structure.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

The invention claimed is:

1. A hot-gas quenching apparatus for quenching a workpiece preheated at an initial temperature to an intermediate temperature at around an isothermal holding temperature for transformation of the workpiece and holding the isothermal holding temperature before cooling the workpiece to room temperature or below with an inert gas and quenching, the apparatus comprising:

a workpiece container configured to contain the preheated workpiece in an inert gas atmosphere or in a vacuum;

a flow path provided with the workpiece container;

a hot-gas circulation duct configured to hold the inert gas as a hot-gas at an intermediate temperature close to an isothermal transformation temperature of the workpiece, wherein the hot-gas circulation duct is provided separately from a space for preheating the workpiece, and the hot-gas circulation duct is arranged to hold the hot-gas therein constantly until the hot-gas is used to quench the workpiece;

a first duct and a second duct, respectively, provided with a control window having an aperture that is controlled, the first duct and the second duct diverging from the flow path, a surface of the workpiece container being connected to an input terminal of the hot-gas circulation duct through the control windows;

a gas cooling unit provided in the second duct and configured to cool the inert gas to room temperature with a cooling medium at room temperature;

a mixer connected at each end of the first duct and the second duct and configured to mix the inert gas introduced, respectively, from the first duct and the second duct for equalization of a temperature of the inert gas from the first duct and the inert gas from the second duct;

a distributor connecting an output terminal of the hot-gas circulation duct to the workpiece container and configured to blow mixed inert gas evenly onto a surface of the workpiece;

a blower provided between the mixer and the distributor and configured to supply the inert gas under pressure from the mixer to the distributor;

an inert gas introducing unit configured to introduce a required amount of the inert gas to the first duct and the second duct, respectively;

a controller configured to control the aperture of the control window to hold a temperature of the mixed inert gas at the intermediate temperature and configured to blow the inert gas of the hot-gas circulation duct to the workpiece for quenching the workpiece with the hot-gas of the intermediate temperature and then hold the workpiece at a constant temperature equal to the isothermal transformation temperature of the workpiece for an isothermal holding of the workpiece;

a heater configured to prevent the workpiece from being cooled due to heat loss during the isothermal holding of the workpiece; and a heat storage contact media provided in the hot-gas circulation duct for controlling the hot-gas at a stable temperature.

2. The hot-gas quenching apparatus as recited in claim 1 wherein the heat storage contact medial has a heat capacity that is 0.3 to 1.0 times as much as a heat capacity of the workpiece.

3. The hot-gas quenching apparatus as recited in claim 1 wherein the heat storage contact media is arranged in a mixer.

4. The hot-gas quenching apparatus as recited in claim 1 wherein the heat storage contact media is at least one metallic ball.

5. The hot-gas quenching apparatus as recited in claim 4 wherein the metallic ball is made of at least one of iron and aluminum.

6. The hot-gas quenching apparatus as recited in claim 1 wherein the heat storage contact media is a metallic capillary.

7. The hot-gas quenching apparatus as recited in claim 1 wherein the heat storage contact media is a metallic chip.

8. A hot-gas quenching apparatus for quenching a workpiece preheated at an initial temperature to an intermediate temperature at around an isothermal holding temperature for transformation of the workpiece and holding the isothermal holding temperature before cooling the workpiece to room temperature or below with an inert gas and quenching, the apparatus comprising:

a workpiece container configured to contain the preheated workpiece in an inert gas atmosphere or in a vacuum;

a hot-gas circulation duct configured to hold an inert gas as a hot-gas at a temperature close to an isothermal transformation temperature, the hot-gas circulation duct including the workpiece container, the temperature to be preliminary set for the hot-gas circulation duct, the hot-gas circulation duct being configured to set the temperature preliminary for cooling toward an isothermal holding of the workpiece such that a final equilibrium temperature becomes equal to a target temperature for an isothermal holding of the workpiece as a result of blowing the inert gas of the hot-gas circulation duct to the workpiece, the target temperature to be set equal to the isothermal transformation temperature of a martensite temperature of the workpiece;

a gas extracting inlet provided in the workpiece container;

a distributor configured to blow the inert gas introduced from the gas extracting inlet evenly onto a surface of the workpiece;

a blower provided in the gas circulation duct and configured to supply the inert gas under pressure to the distributor for, in cooling towards isothermal holding, causing an equilibrium temperature to be equal to the target temperature in a final stage of the isothermal holding by blowing the insert gas of the hot-gas circulation duct to the workpiece;

a temperature adjuster including a heater and a cooler provided in the hot-gas circulation duct configured to hold the target temperature of the insert gas at the intermediate temperature, the cooler configured to extract part of the inert gas from the hot-gas circulation duct, cool the extracted gas with a water pipe, and then return the cooled gas to the hot-gas circulation duct; and a heat storage contact media provided in the hot-gas circulation duct, the heat storage contact media having a heat capacity larger than that of the workpiece, the heat storage contact media being for stabilizing the temperature of the inert gas blown from the blower, the heat storage contact media including a material for exchanging accumulated heat with the blown inert gas to smooth fluctuations in the temperature of the blown inert gas.

9. The hot-gas quenching apparatus as recited in claim 8 wherein the heat storage contact medial has a heat capacity that is 0.3 to 1.0 times as much as a heat capacity of the workpiece.

10. The hot-gas quenching apparatus as recited in claim 8 wherein the heat storage contact media is arranged in a mixer.

11. The hot-gas quenching apparatus as recited in claim 8 wherein the heat storage contact media is at least one metallic ball.

12. The hot-gas quenching apparatus as recited in claim 11 wherein the metallic ball is made of at least one of iron and aluminum.

13. The hot-gas quenching apparatus as recited in claim 8 wherein the heat storage contact media is a metallic capillary.

14. The hot-gas quenching apparatus as recited in claim 8 wherein the heat storage contact media is a metallic chip.

* * * * *

UNITED STATES PATENT AND TRADEMARK OFFICE

CERTIFICATE OF CORRECTION

PATENT NO. : 7,547,410 B2
APPLICATION NO. : 12/026686
DATED : June 16, 2009
INVENTOR(S) : Taniguchi It is certified that error appears in the above-identified patent and that said Letters Patent is hereby corrected as shown below:

Claim 2, Column 24, Line 55, replace “medial” with --media--.

Claim 9, Column 26, Line 20, replace “medial” with --media--.

Signed and Sealed this

Twenty-ninth Day of September, 2009

David J. Kappos

David J. Kappos
*Director of the United States Patent and Trademark Office*